US009709959B2

(12) United States Patent
Kanno

(10) Patent No.: US 9,709,959 B2
(45) Date of Patent: Jul. 18, 2017

(54) ELECTRIC TIMEPIECE WITH SOLAR CELL

(71) Applicants: Citizen Holdings Co., Ltd, Nishitokyo-shi, Tokyo (JP); Citizen Watch Co., Ltd., Nishitokyo-shi, Tokyo (JP)

(72) Inventor: Yudai Kanno, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 15/108,924

(22) PCT Filed: Jun. 23, 2015

(86) PCT No.: PCT/JP2015/068008
§ 371 (c)(1),
(2) Date: Jun. 29, 2016

(87) PCT Pub. No.: WO2015/199064
PCT Pub. Date: Dec. 30, 2015

(65) Prior Publication Data

US 2016/0357156 A1 Dec. 8, 2016

(30) Foreign Application Priority Data

Jun. 24, 2014 (JP) ..... 2014-128797

(51) Int. Cl.
*G04G 19/00* (2006.01)
*G04C 10/02* (2006.01)
(Continued)

(52) U.S. Cl.
CPC ..... *G04C 10/02* (2013.01); *G04B 19/06* (2013.01); *G04G 17/08* (2013.01); *G04G 19/00* (2013.01)

(58) Field of Classification Search
CPC ..... G04G 17/08; G04G 19/00; G04G 19/06; G04C 10/02
See application file for complete search history.

(56) References Cited

U.S. PATENT DOCUMENTS 4,553,851 A * 11/1985 Matsumoto ..... G04C 3/008 368/203
6,521,822 B2 * 2/2003 Ito ..... G04C 10/02 136/244
(Continued)

FOREIGN PATENT DOCUMENTS

CN 1726438 A 1/2006
DE 3346046 A1 7/1984
(Continued)

OTHER PUBLICATIONS

International Search Report PCT/ISA/210 for International Application No. PCT/JP2015/068008 Dated Sep. 9, 2015.

*Primary Examiner* — Sean Kayes
(74) *Attorney, Agent, or Firm* — Harness, Dickey & Pierce, P.L.C.

(57) ABSTRACT

An electric timepiece with a solar cell in which an aesthetic aspect is satisfied at low costs without decorating a dial trim ring and the power generation amount sufficient for driving a timepiece is obtained is provided. An electric timepiece with a solar cell includes a dial, a light permeable dial trim ring disposed to surround a center portion of the dial, and a solar cell disposed outside an outside surface of the dial trim ring to face the outside surface. An inclination surface is formed at least in a part of the outside surface of the dial trim ring, which faces the solar cell, the inclination surface inclines toward the center portion of the dial as going from the dial in a height direction of the dial trim ring, and a different color member having a color different from that of a light-receiving surface of the solar cell is provided to face a lower surface of the dial trim ring.

15 Claims, 21 Drawing Sheets

(51) Int. Cl.
*G04G 17/08* (2006.01)
*G04B 19/06* (2006.01)

(56) References Cited

U.S. PATENT DOCUMENTS

| | | | | |
|---|---|---|---|---|
| 7,333,401 | B2 * | 2/2008 | Kawakami | C23C 28/00 368/232 |
| 7,400,556 | B2 * | 7/2008 | Osa | G04C 10/02 368/204 |
| 2002/0157700 | A1 * | 10/2002 | Ito | G04C 10/02 136/244 |
| 2006/0050618 | A1 * | 3/2006 | Osa | G04C 10/02 368/205 |
| 2006/0153011 | A1 * | 7/2006 | Osa | G04C 10/02 368/205 |
| 2007/0195651 | A1 * | 8/2007 | Kawakami | C23C 28/00 368/232 |
| 2012/0170423 | A1 * | 7/2012 | Fujisawa | G04C 10/02 368/10 |

FOREIGN PATENT DOCUMENTS

| | | | |
|---|---|---|---|
| EP | 1574919 | A1 | 9/2005 |
| FR | 2538573 | A1 | 6/1984 |
| GB | 2133589 | A | 7/1984 |
| HK | 22987 | A | 3/1987 |
| JP | S59-120983 | A | 7/1984 |
| JP | 2004-212389 | A | 7/2004 |
| JP | 2005-114650 | A | 4/2005 |
| JP | 2005-249720 | A | 9/2005 |
| JP | 2006-184059 | A | 7/2006 |
| JP | 2006-313103 | A | 11/2006 |
| JP | 2014-044100 | A | 3/2014 |
| WO | WO-2004/055605 | A1 | 7/2004 |

* cited by examiner

ELECTRIC TIMEPIECE WITH SOLAR CELL

CROSS-REFERENCE TO RELATED APPLICATIONS

This application is the U.S. National Phase application of PCT Application No. PCT/JP2015/068008 filed on Jun. 23, 2015, which claims priority to Japanese Patent Application No. 2014-128797 filed on Jun. 24, 2014, the contents of each of which are incorporated herein by reference.

TECHNICAL FIELD

This invention is related to an electric timepiece with a solar cell.

BACKGROUND ART

An electric timepiece with a solar cell using power generated by the solar cell as a timepiece driving source has been known. In one example, the solar cell is disposed behind a light-permeable dial or at substantially right angle outside a light-permeable dial trim ring disposed around an outer circumference of a surface of the dial. However, the solar cell disposed as described above allows navy color of the solar cell to be seen through the dial or the dial trim ring, resulting in deterioration in an aesthetic aspect.

Along with recent improvement in a power generation performance of a solar cell and a progress in a technology of lowering power consumption for driving a timepiece, a power generation amount sufficient for driving a timepiece can be obtained with the structure in which the solar cell is disposed behind the light-permeable dial even though the dial is semi-permeably decorated. Such a decorated dial makes the solar cell indistinctive to satisfy the aesthetic aspect.

In contrast, in the structure in which the solar cell is disposed at substantially right angle outside the light-permeable dial trim ring disposed in the outer circumference of the surface of the dial, the light-permeable dial trim ring has a three-dimensional shape. It is therefore difficult for the dial trim ring to be semi-permeably decorated.

Patent Literature 1 discloses, as an example of semi-permeably decorating the dial trim ring, a structure in which a metal thin film layer is formed in the inner circumference surface of the light-permeable dial trim ring, and a coloring material or a fluorescent material and a light diffusion material are blended in the material of the dial trim ring. This structure makes the semi-permeable dial trim ring to be seen as a metal color, and the power generation amount sufficient for driving the timepiece is obtained with this structure.

CITATION LIST

Patent Literature

Patent Literature 1: JP 2005-249720A (Paragraphs 0059, 0095, and 0099, FIGS. 6 and 14).

SUMMARY

Technical Problem

When manufacturing the dial trim ring having the structure shown in Patent Literature 1, it is necessary to mask the dial trim ring except the inner circumference surface, and to control the thickness of the metal thin film of the inner circumference surface, resulting in an increase in costs.

The present invention has been made in view of the above circumferences, and aims to provide an electric timepiece that can obtain at low costs the power generation amount sufficient for driving the timepiece without deteriorating the aesthetic aspect of the dial trim ring.

Solution to Problem

To solve the above problem, the present invention provides an electric timepiece with a solar cell including a dial, a light permeable dial trim ring disposed to surround a center portion of the dial, the dial trim ring including at least a bottom and an outside surface, and a solar cell disposed outside the outside surface to face the outside surface, wherein the dial trim ring includes a first surface at least in a part of the outside surface and a second surface at least in a part of the bottom, a sum of a first angle at which the first surface inclines toward the center portion of the dial as going from the dial in a height direction and a second angle at which the second surface inclines downward in the height direction as going from the center portion exceeds 0 degree, and a different color member having a color different for that of a light-receiving surface of the solar cell is provided to face the second surface.

The present invention provides the electric timepiece with the solar cell, wherein the first surface and the second surface are smooth surfaces.

The present invention provides the electric timepiece with the solar cell, wherein the different color member is disposed in the bottom or is a member formed in the bottom.

The present invention provides the electric timepiece with the solar cell, wherein the different color member is a member disposed in the bottom, and the different color member is closely disposed in the bottom.

The present invention provides the electric timepiece with the solar cell, wherein at least one of the first surface in which the first angle exceeds 0 degree and the second surface in which the second angle exceeds 0 degree is formed in an entire circumference of the dial trim ring.

The present invention provides the electric timepiece with the solar cell, wherein the first angle exceeds 0 degree.

The present invention provides the electric timepiece with the solar cell, wherein the solar cell is disposed to separate from the outside surface, and a substance or a member having a refractive index smaller than that of the dial trim ring is provided between the first surface and the solar cell.

The present invention provides the electric timepiece with the solar cell, wherein the first surface is formed from an end portion of the outside surface on the dial side to an end portion of the outside surface on the side opposite to the dial side.

The present invention provides the electric timepiece with the solar cell, wherein the first surface inclines at a constant angle toward the center portion of the dial as going from the dial in the height direction.

The present invention provides the electric timepiece with the solar cell, wherein the first surface is not formed from the end portion of the outside surface on the dial side to a position at a predetermined height in the outside surface, and is formed at least in a part between the position at the predetermined height in the outside surface and the end portion of the outside surface on the side opposite to the dial side.

The present invention provides the electric timepiece with the solar cell, wherein the second angle exceeds 0 degree.

The present invention provides the electric timepiece with the solar cell, wherein at least a part of the second surface extends to a position lower than the surface of the dial in the height direction.

The present invention provides the electric timepiece with the solar cell, wherein the second surface is formed from a side surface in an outer circumference of the dial to the outside surface.

The present invention provides the electric timepiece with the solar cell, wherein the second surface inclines downward in the height direction at a constant angle as going from the center portion.

The present invention provides the electric timepiece with the solar cell, wherein the second surface is not formed from an outer circumference end portion of the bottom to a position in a predetermined length in the bottom and is formed at least in a part between the position in the predetermined length in the bottom to an inner circumference end portion of the bottom.

Advantageous Effects

According to the electric timepiece with the solar cell of the present invention, when looking at the dial trim ring, the color of the different color member provided to face the bottom of the dial trim ring is viewed to provide the decoration effect, and the color of the solar cell becomes indistinctive.

It becomes therefore unnecessary to provide semi-permeable decoration to the light permeable dial trim ring, and the electric timepiece with the solar cell that can obtain at low costs the power generation amount sufficient for driving the timepiece without deteriorating the aesthetic aspect of the dial trim ring can be achieved.

DESCRIPTION OF EMBODIMENTS

Hereinafter embodiments of the present invention will be described with reference to the drawings.

Figure 1:
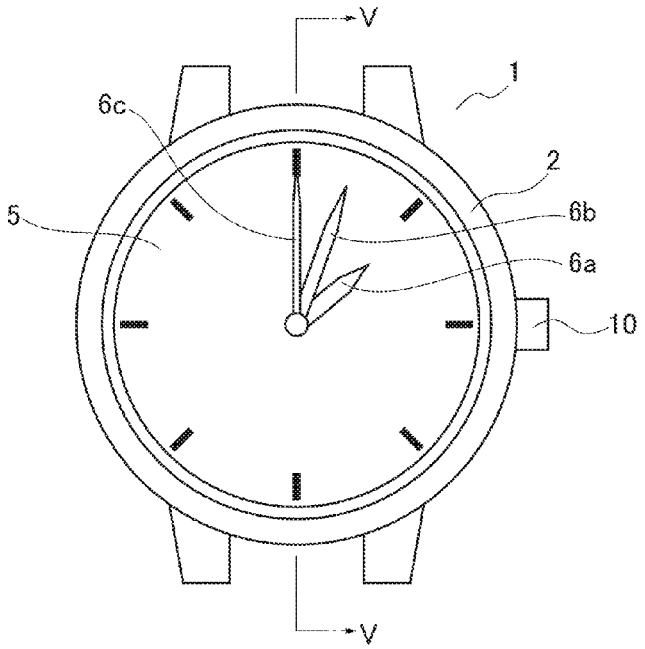
FIG. 1 is a front view illustrating an electric timepiece with a solar cell according to the present invention.
Figure 2:
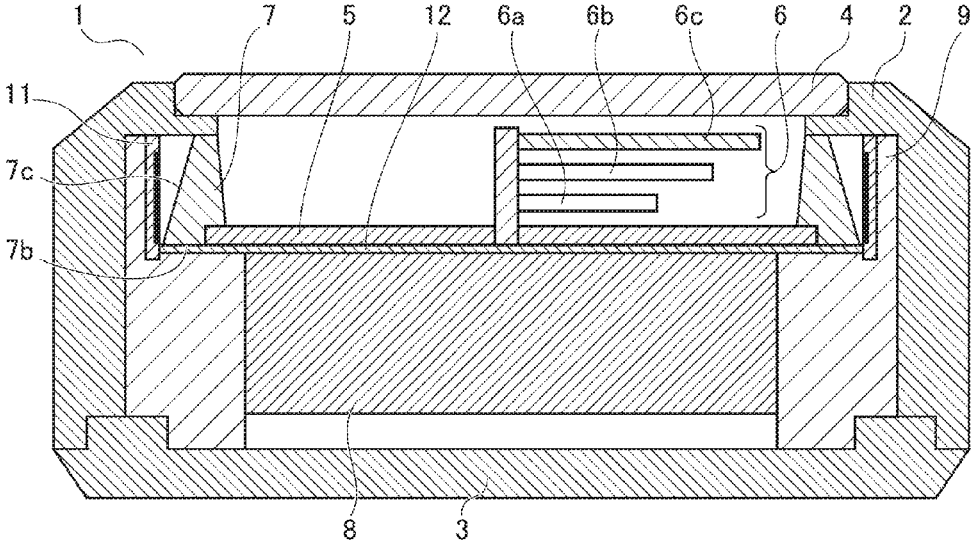
FIG. 2 is a cross sectional view illustrating the electric timepiece with the solar cell along a V-V line in FIG. 1.

FIG. 1 is a plane view illustrating a front (dial side) of a timepiece according to the embodiments of the present invention. FIG. 2 is a cross sectional view along a V-V line in FIG. 1.

Embodiment 1

As illustrated in FIGS. 1 and 2, an electric timepiece with a solar cell 1 of the present embodiment includes a timepiece case 2 having on a front side thereof a glass 4 and on a rear side thereof a back lid 3. A movement 8 is built in the timepiece case 2. A through hole (not shown) is formed in a side surface of the timepiece case 2. A winding steam (not shown) fixed to a crown 10 as an external operation member is inserted into the through hole. The winding steam is connected to a gear train (not shown) inside the movement 8 by pulling the crown 10, and an operation required for the electric timepiece with the solar cell 1 is achieved by the rotation of the crown 10.

An electric contact provided in the movement 8 is switched on and off by rotating the crown 10. An operation required for the electric timepiece with the solar cell 1 may be electrically achieved by detecting the rotation operation of the crown 10.

A dial 5 is disposed inside the glass 4. A hand 6 (hour hand 6*a*, minute hand 6*b*, and second hand 6*c*) that is driven by the movement 8 is coaxially disposed between the glass 4 and the dial 5. A dial trim ring 7 is disposed near an outer circumference of the dial 5 to surround a center portion of the dial 5. A solar cell 11 is disposed outside an outside surface 7*c* of the dial trim ring 7. A plate different color member 12 including a portion facing a lower surface 7*b* (one example of second surface) of the dial trim ring 7 as a part of a bottom of the dial trim ring 7 is disposed behind the dial 5.

A doughnut-shaped casing ring 9 is disposed in a rear surface of the different color member 12. The movement 8 is fitted into the casing ring 9. The movement 8 includes inside thereof a circuit board and a connection spring electrically connected to the circuit board (circuit board and connection spring are not shown). The different color member 12 is a member having a color different from a color of a light-receiving surface of the solar cell 11 and is configured by a film or paint that enhance a decoration effect of the dial trim ring 7. In one example, the different color member 12 may be configured by a metallic film or a film having various colors different from the color of the light-receiving surface of the solar cell 11.

When the different color member 12 is configured by the paint, the lower surface 7*b* of the dial trim ring 7 may be directly painted, or the casing ring 9 disposed to face the lower surface 7*b* of the dial trim ring 7 or a member different from the casing ring 9 may be painted. In any case, the selection of the color is not much limited because paint containing various color pigments more than that for coloring an inside surface 7*d* or the outside surface 7*c* of the dial trim ring 7 can be used.

To be specific, when the inside surface 7*d* or the outside surface 7*c* of the dial trim ring 7 is colored by paint, it is necessary to use paint having a light transmittance that enables power generation by the solar cell 11. On the other hand, the light permeability of the paint for use in the different color member 12 is not limited because the different color member 12 provides the coloring effect to the dial trim ring 7 with the light reflected from the surface of the different color member 12. Accordingly, for example, light-blocking paint can be used for the different color member 12 as long as the light permeability is not limited. This is not only for the different color member 12 configured by the paint, but also for the different color member 12 configured by a color member.

The surface of the different color member 12 has a reflection surface which reflects light. The reflection surface may be configured by the paint or the film constituting the different color member 12 or the reflection surface may be configured by forming a fine asperity pattern, which reflects light, such as a triangular pyramid, half-sphere, and cylinder on the surface of the film constituting the different color member or the surface of the painted member.

Figure 3:
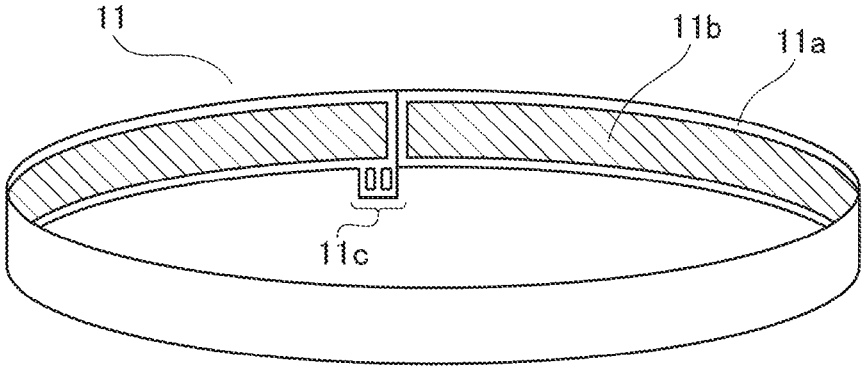
FIG. 3 is a perspective view illustrating the solar cell.

FIG. 3 is a perspective view illustrating the solar cell 11. The solar cell 11 includes a film base substrate 11*a* made of resin such as polyethylene terephthalate and a photovoltaic layer 11*b* formed on the base substrate 11*a* to contain a semiconductor material such as amorphous silicon. The base substrate 11*a* is a flexible elongated strip. The solar cell 11 includes, in a lower portion of one end thereof in the longitudinal direction, an electrode 11*c* as a terminal that obtains power generated in the photovoltaic layer 11*b*.

The electrode 11*c* of the solar cell 11 is electrically connected to the above-described connection spring to supply the generated power from the solar cell 11 to the movement 8. The solar cell 11 is incorporated into the casing ring 9 such that the photovoltaic layer 11*b* faces the center of the timepiece. In addition, the solar cell 11 has flexibility. The solar cell 11 thus abuts on the inside of the casing ring 9 by the tensional force that stretches the solar cell 11 back to the original straight state when the solar cell 11 is rounded as illustrated in FIG. 3.

As illustrated in FIG. 3, the solar cell 11 has a length such that the solar cell 11 can be disposed to abut on the entire circumference of the inside of the casing ring 9. However, the solar cell 11 may be disposed to abut on a part of the inside of the casing ring 9. The solar cell 11 is disposed on the surface of the dial 5 at a substantially right angle, but may be disposed to incline to the dial 5.

Figure 4:
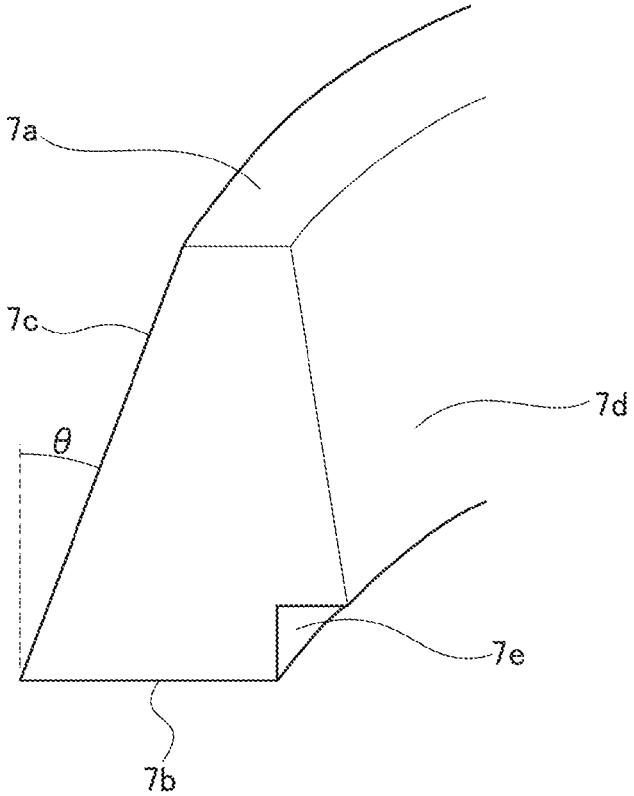
FIG. 4 is a partial cross sectional view illustrating a dial trim ring.

FIG. 4 is a partial cross sectional view illustrating the dial trim ring 7. The dial trim ring 7 is molded by transparent resin. The dial trim ring 7 has light permeability. An upper surface 7*a* of the dial trim ring 7 is parallel to the surface of the dial 5. A lower surface 7*b* of the dial trim ring 7, which is the bottom, is parallel to the upper surface 7*a*. The entire circumference of the entire of the outside surface 7*c* (one example of first surface) of the dial trim ring 7 inclines inward at an inclination angle (first angle) θ (>0 degree) with reference to the outside end of the lower surface 7*b*.

The outside surface 7*c* includes the inclination surface that inclines at a constant inclination angle θ in a direction toward the center portion of the dial 5 as going from the dial 5 in the height direction of the dial trim ring 7. The inclination surface is formed from an end portion (lower end portion in FIG. 4) of the outside surface 7*c* on the dial 5 side to an end portion (upper end portion in FIG. 4) of the outside surface 7*c* on the side opposite to the dial 5 side. Namely, the inclination surface is formed in the entire outside surface 7*c*. The outside surface 7*c* is a smooth surface.

The inside surface 7*d* of the dial trim ring 7 rises to surround the center portion of the dial 5. The inside surface 7*d* of the dial trim ring 7 includes in the bottom edge thereof a concave portion 7*e*. The concave portion 7*e* is placed at the outer circumference portion of the dial 5. In addition, the upper surface 7*a* and the lower surface 7*b* of the dial trim ring 7 shown in FIG. 4 are parallel to each other. Namely, the inclination angle of the lower surface 7*b* (angle corresponding to downward inclination in height direction of dial trim ring 7 as going from center portion of dial 5 (second angle)) ϕ is 0 degree. Accordingly, the sum of the inclination angle θ and the inclination angle ϕ (=θ+ϕ) exceeds 0 degree. In addition, it is not always necessary for the upper surface 7*a* and the lower surface 7*b* to be parallel to each other. It is also not always necessary for the upper surface 7*a* to have a flat surface. The upper surface 7*a* may have asperity.

It is preferable for the dial trim ring 7 to be made of transparent resin such as polycarbonate or acrylic resin having a refractive index larger than that of air. Semi-transparent resin in which pigment is mixed in the inside may be used.

Next, referring to FIGS. 5 and 6, colors which are viewed from the dial trim ring 7 will be described.

Figure 5:
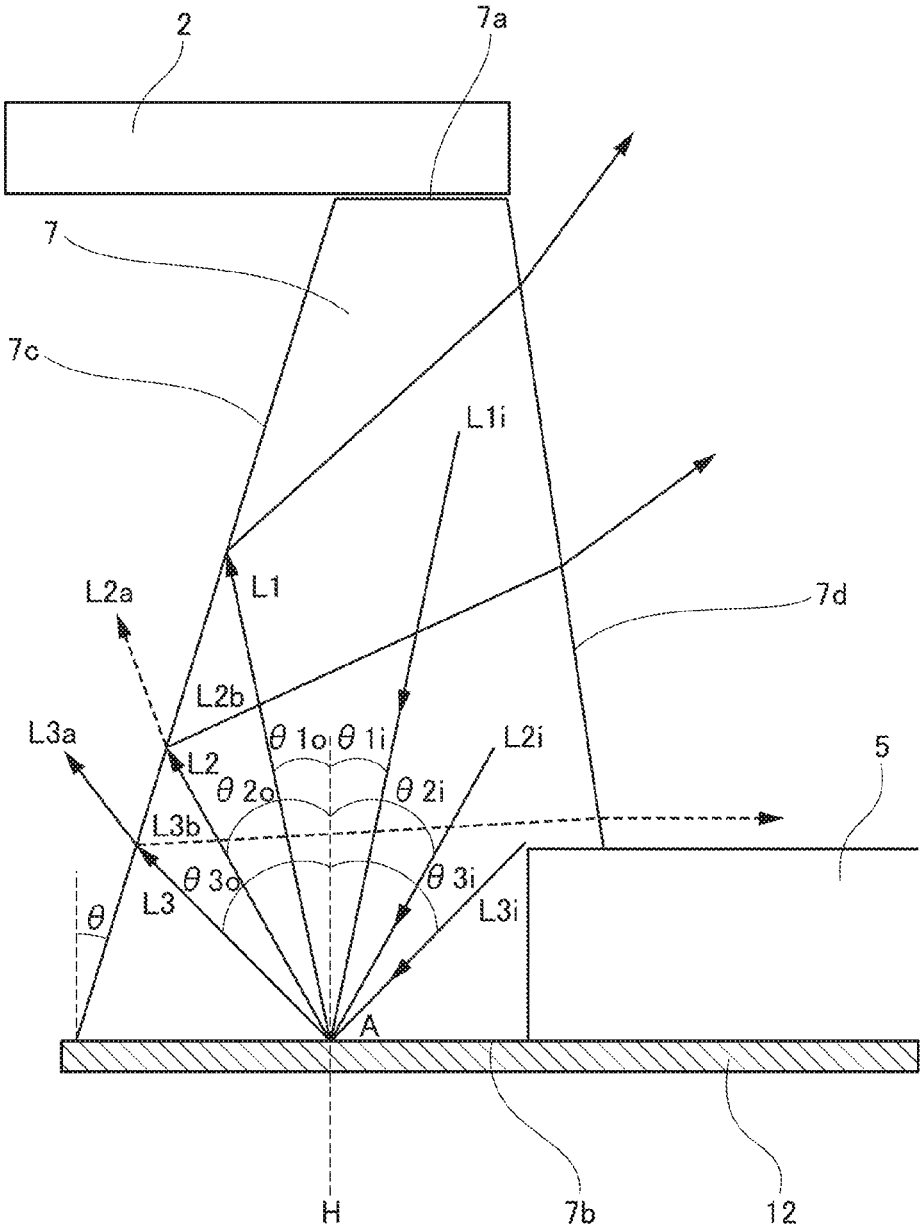
FIG. 5 is a view for explaining a path of light that reflects from a different color member, and is incident on an inclined outside surface of the dial trim ring.

FIG. 5 is a view for explaining paths of lights that are reflected on the different color member 12 provided on the rear of the lower surface 7*b* of the dial trim ring 7 in the dial trim ring of the present invention in which the outside surface 7*c* inclines to the dial 5.

In FIG. 5, the entire outside surface 7*c* of the dial trim ring 7 inclines inward (in direction toward center portion of dial 5) at a constant inclination angle θ from the normal line H to the surface of the dial 5. L1*i* to L3*i* are lights that are incident on the surface of the different color member 12 at a point A in different directions, and L1 to L3 are lights in which the lights L1*i* to L3*i* are reflected from the surface of the different color member 12 at the point A of the different color member 12. The lights L1, L2, and L3 reflected at the point A have a relationship of emission angles relative to the surface of the different color member 12 as light L3>light L2>light L1.

A light has a property in which an incident angle is equal to a reflection angle when the light reflects from a certain surface. In FIG. 5, the lights, which are incident on the surface of the different color member 12 and reflect from the surface of the different color member 12, reflect such that an angle (incident angles θ1*i* to θ3*i*) between the normal line H to the surface of the different color member 12 and each light L1*i* to L3*i* incident on the surface of the different color member 12 is equal to an angle (reflection angles θ1*o* to θ3*o*) between the normal line H to the surface of the different color member 12 and each light L1 to L3 reflected from the surface of the different color member 12.

Similarly, the light, which is incident on the outside surface 7*c* and reflects from the outside surface 7*c*, reflects such that an angle (incident angle) between the normal line of the outside surface 7*c* and the light incident on the outside surface 7*c* is equal to an angle (reflection angle) between the normal line of the outside surface 7*c* and the light reflected from the outside surface 7*c*. For example, for the reflection at the point A of the different color member 12 at a reflection angle of the light L1, the incident angle of the light L1*i* to the point A is smaller than the incident angles of the lights L2*i* and L3*i* of the lights L2 and L3.

The light having such a small incident angle mostly permeates the lower surface 7*b* without being reflected from the lower surface 7*b*, and reflects from the surface of the different color member 12 that is closely disposed on the lower surface 7*b*. The light L1*i* slightly reflects from the surface of the lower surface 7*b* without permeating the lower surface 7*b* to reach the surface of the different color member 12. The incident angles of the lights L2*i* and L3*i* are larger than that of the light L1*i*. The lights L2*i* and L3*i* do not permeate the lower surface 7*b* to reach the surface of the different color member 12, and the ratio of the light that reflects from the surface of the lower surface 7*b* increases in accordance with an increase in the incident angle.

The light reflected from the surface of the different color member 12 reflects the color of the different color member 12. The light reflected from the surface of the lower surface 7*b* without reaching the surface of the different color member 12 does not reflect the color of the different color member 12. However, the light, which is incident on the surface of the different color member 12 at an incident angle to reflect on the inside of the dial trim ring 7 and to emit from the inside surface 7*d* of the dial trim ring 7 as described below, has a small ratio that reflects from the surface of the lower surface 7*b*. Such a light therefore reflects the color of the different color member 12.

The outside surface 7*c* on which the inclination surface is formed and the solar cell 11 have therebetween air. The dial trim ring 7 has a reflective index larger than that of the air. The light thus reflects from the outside surface 7*c*. Namely, in this case, the inclination surface and the solar cell 11 have therebetween air as a substance having a reflective index smaller than that of a material constituting the dial trim ring 7.

Based on the property that the incident angle is equal to the reflection angle on the outside surface 7*c*, the entire light L1 emits inside the dial trim ring 7 from the vicinity of the upper end portion of the inside surface 7*d* of the dial trim ring 7 with the shape of the dial trim ring 7 shown in FIG. 5 when the light L1 travels from the point A to the outside surface 7*c* in the direction of the light L1. In addition, it is assumed that the light L1 totally reflects from the outside surface 7*c* at the incident angle of the light L1 to the outside surface 7*c*.

Based on the property that the incident angle is equal to the reflection angle on the outside surface 7*c*, the reflection angle of the light L2 on the outside surface 7*c* is defined, and a light L2*b*, which is a part of the light L2, reflects on the outside surface 7*c* to emit inside the dial trim ring 7 from the vicinity of the center of the inside surface 7*d* in the height direction. A light L2*a*, which is the rest of the light L2, permeates the outside surface 7*c*. The light L2*a* contributes to the power generation by the solar cell 11.

Based on the property that the incident angle is equal to the reflection angle on the outside surface 7*c*, the reflection angle of the light L3 on the outside surface 7*c* is defined, and a light L3*b*, which is a part of the light L3, reflects from the outside surface 7*c* to emit inside the dial trim ring 7 from the vicinity of the lower end portion of the inside surface 7*d* in the height direction. A light L3*a*, which is the rest of the light L3, permeates the outside surface 7*c*. The light L3*a* contributes to the power generation by the solar cell 11. By reflecting the light from the surface of the different color member 12, the amount of light which is incident on the light-receiving surface of the solar cell 11 such as the light L2*a* and the light L3*a* is increased, and the light which contributes to the power generation by the solar cell 11 can be obtained.

A light incident on a certain surface usually has a property that the reflection amount increases while the permeation amount decreases in accordance with an increase in an incident angle to that surface, and the reflection amount decreases while the permeation amount increases in accordance with a decrease in the incident angle to that surface. Based on this property, the relationship of the incident angle to the outside surface 7*c* is light L1>light L2>light L3, and thus, the relationship of the amount of light that emits inside the dial trim ring 7 after reflecting from the outside surface 7*c* is light L1>light L2*b*>light L3*b*. Accordingly, the amount of light L1 at an angle that can easily see the dial trim ring 7 from the oblique upward increases while the amount of light L3*b*, which is approximately parallel to the surface of the dial 5, at an angle that cannot easily see the dial trim ring 7 decreases.

The light L1 and the light L2*b* that reflect from the surface of the different color member 12 and emit inside the dial trim ring 7 reflect the color of the different color member 12 when reflecting from the different color member 12. Accordingly, when these lights emit outside the dial trim ring 7 to be viewed, the dial trim ring 7 is viewed as the color of the different color member 12. Since the amount of light L3*b* is small, the light L3*b* hardly contributes to the dial trim ring 7 to be viewed as the color of the different color member 12.

It is preferable for the light-receiving surface of the solar cell 11 to separate from the outside surface 7*c*, as shown in FIG. 2, in order to reliably reflect the color of the different color member 12 by the lights L1 and L2*b*. If a part or the entire of the light-receiving surface of the solar cell 11 is closely disposed on the outside surface 7*c* without having an air layer therebetween, and the light-receiving surface of the solar cell 11 and the dial trim ring 7 have about the same refractive index, the light incident on the outside surface 7*c* reflects from the light-receiving surface of the solar cell 11 after permeating the outside surface 7*c* in the closely disposed portion. When this light emits from the inside surface 7*d*, the color of the light-receiving surface of the solar cell 11 is reflected, so that it becomes difficult to recognize the color of the different color member 12. However, when the refractive index of the light-receiving surface of the solar cell 11 differs from the refractive index of the dial trim ring 7, the light is prevented from permeating the outside surface 7*c* to prevent the color of the light-receiving surface of the solar cell 11 from being reflected.

Figure 6:
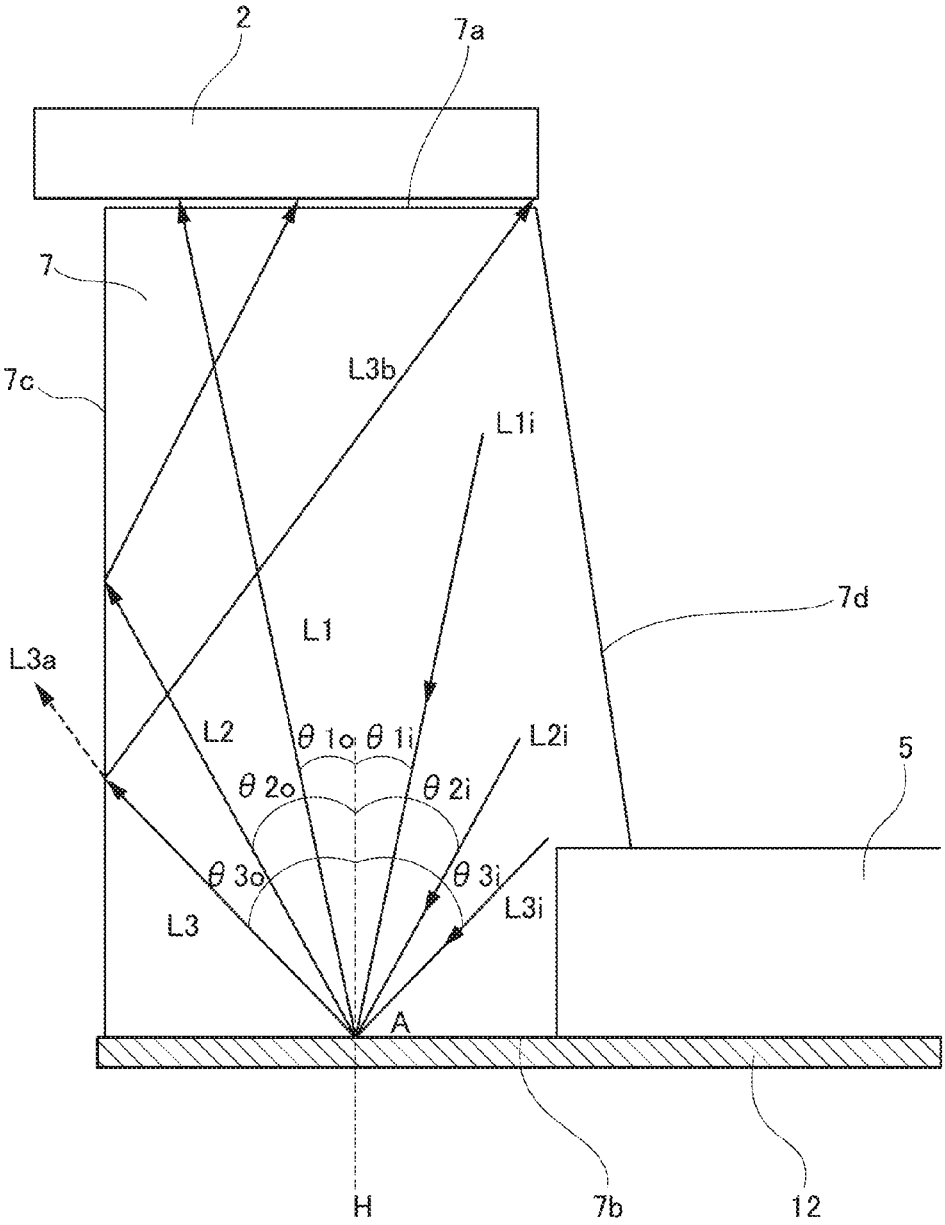
FIG. 6 is a view for explaining a path of light that reflects from a different color member, and is incident on a non-inclined outside surface of a dial trim ring.

FIG. 6 is a view for explaining the path of light that reflects from the different color member 12 provided in the rear of the lower surface of a conventional dial trim ring in which the outside surface does not inclines to the dial.

The dial trim ring 7, dial 5, and different color member 12 shown in FIG. 6 are the same as those in FIG. 5 except that the outside surface 7*c* of the dial trim ring 7 does not incline to the dial 5. Namely, the shape in the dial trim ring 7 except the shape of the outside surface 7*c*, the position of the point A on the different color member 12, and the reflection angles of the lights L1 to L3 at the point A are the same as those in FIG. 5.

FIG. 6 shows the paths of lights L1 to L3 based on the property that the incident angle and the reflection angle of the light on a certain surface are equal to each other. When the dial trim ring 7 has the shape as shown in FIG. 6, the light L1 from the point A travels to the upper surface 7*a*, and emits above the dial trim ring 7 from the vicinity of the left side portion of the upper surface 7*a* of the dial trim ring 7 in the horizontal direction.

Based on the property that the incident angle is equal to the reflection angle on the outside surface 7*c*, the reflection angle of the light L2 on the outside surface 7*c* is defined, and the light L2 emits inside the dial trim ring 7 from the vicinity of the center of the upper surface 7*a* in the horizontal direction. In addition, it is assumed that the light L2 totally reflects from the outside surface 7*c*.

Based on the property that the incident angle is equal to the reflection angle on the outside surface 7*c*, the reflection angle of the light L3 on the outside surface 7*c* is defined, and a light L3*b*, which is a part of the light L3, reflects from the outside surface 7*c* to emit above the dial trim ring 7 from the vicinity of the right end portion of the upper surface 7*a* in the horizontal direction. The rest of the light L3*a* of the light L3 permeates the outside surface 7*c*.

As shown in FIG. 5, when the outside surface 7*c* of the dial trim ring 7 inclines, the lights L1, L2*b*, and L3*b* emit from the inside surface 7*d* of the dial trim ring 7. On the other hand, as shown in FIG. 6, when the outside surface 7*c* of the dial trim ring 7 does not incline inward, the lights L1, L2*b*, and L3*b* emit above the dial trim ring 7 from the upper surface 7*a*.

Namely, by forming the outside surface 7*c* of the dial trim ring 7 to incline inside the dial trim ring 7, the light, which reflects from the different color member 12 and is incident on the outside surface 7*c*, is reflected toward the inside surface 7*d* to emit inside the dial trim ring 7.

As shown in FIGS. 2 and 6, the timepiece case 2 is disposed on the upper surface 7*a* of the dial trim ring 7. When the dial trim ring 7 is seen from the oblique upward, the lights L1, L2*b*, and L3*b* pass through a region without the timepiece case 2 to reach a viewer side in the dial trim ring 7 shown in FIG. 5. However, in the dial trim ring 7 shown in FIG. 6, the lights L1, L2, and L3*b* travel to the rear of the timepiece case 2, are blocked by the timepiece case 2, and does not reach the viewer side.

The electric timepiece 1 with the solar cell shown in FIGS. 2, 5, and 6 has a configuration in which the timepiece case 2 is positioned on the upper surface 7*a* of the dial trim ring 7. Similarly, when another member that blocks the light is disposed on the upper surface 7*a* of the dial trim ring 7, the lights L1, L2, and L3*b* do not reach the viewer side in the dial trim ring 7 shown in FIG. 6.

Even in the dial trim ring 7 as shown in FIG. 5, all of the lights reflected from the different color member 12 do not reflect toward the inside surface 7*d*, and some of the lights reach to the upper surface 7*a* as the light toward the vicinity of the upper end portion of the outside surface 7*c* from a point located closer to the dial 5 than the point A. However, comparing to the dial trim ring 7 shown in FIG. 6, the most of the lights that reflects on the respective points on the different color member 12 toward the outside surface 7*c* emit from the inside surface 7*d* in the dial trim ring 7 shown in FIG. 5.

The dial trim ring 7 shown in FIG. 5 is viewed as the color of the different color member 12 by the inclined outside surface 7*c* while the dial trim ring 7 shown in FIG. 6 is viewed as a dark color by the non-inclined outside surface 7*c*.

Next, with reference to FIGS. 7 and 8, the relationship between the light which reflects from the outside surface 7*c* of the dial trim ring 7 and reach the viewer side, and the critical angle of the outside surface 7*c* of the dial trim ring 7 will be described.

Note that the critical angle is the minimum incident angle that causes the total reflection when a light is incident on a substance having a small refractive index from a substance having a large refractive index.

Figure 7:
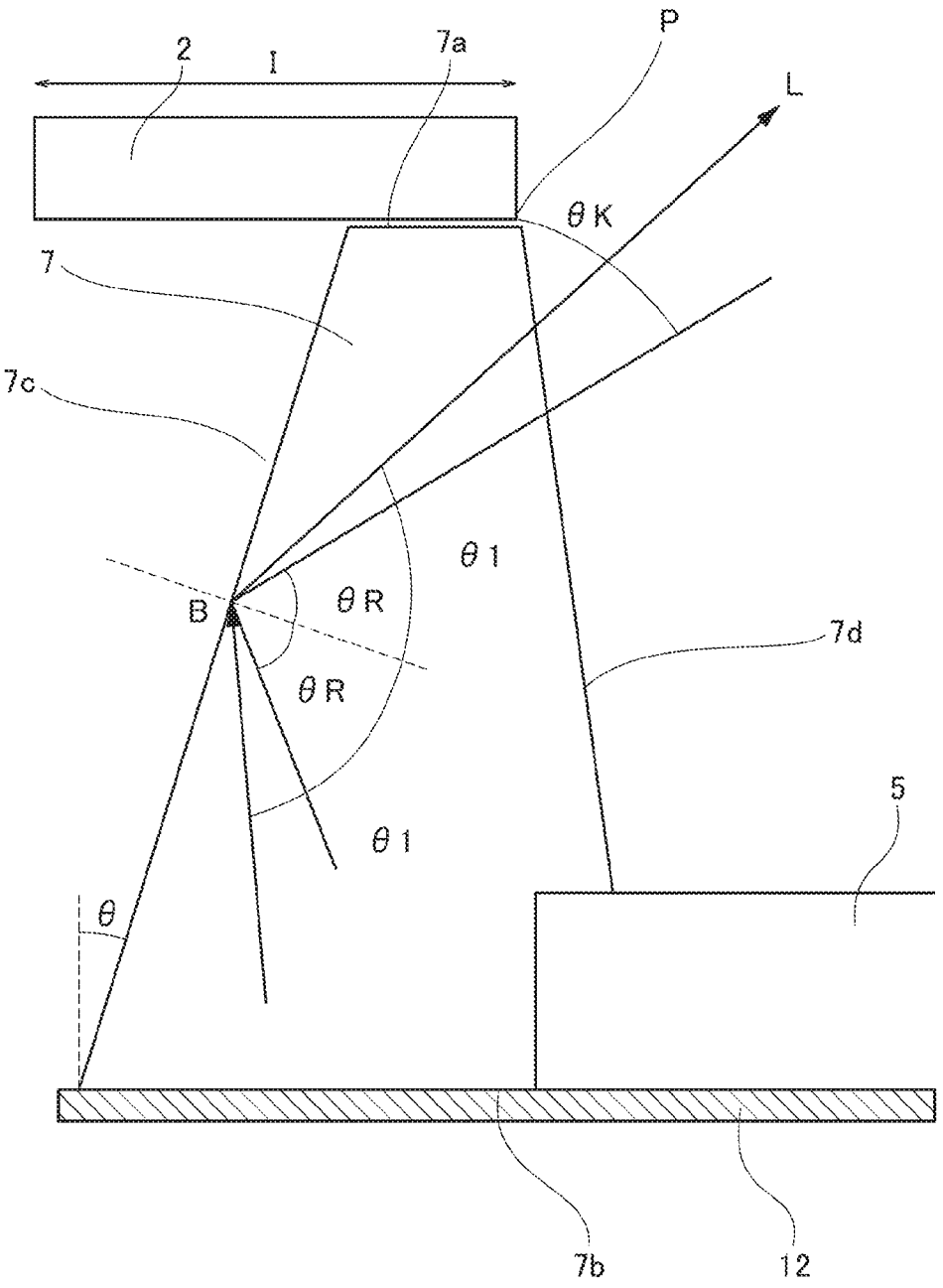
FIG. 7 is a view for explaining a critical angle of the inclined outside surface of the dial trim ring.
Figure 8:
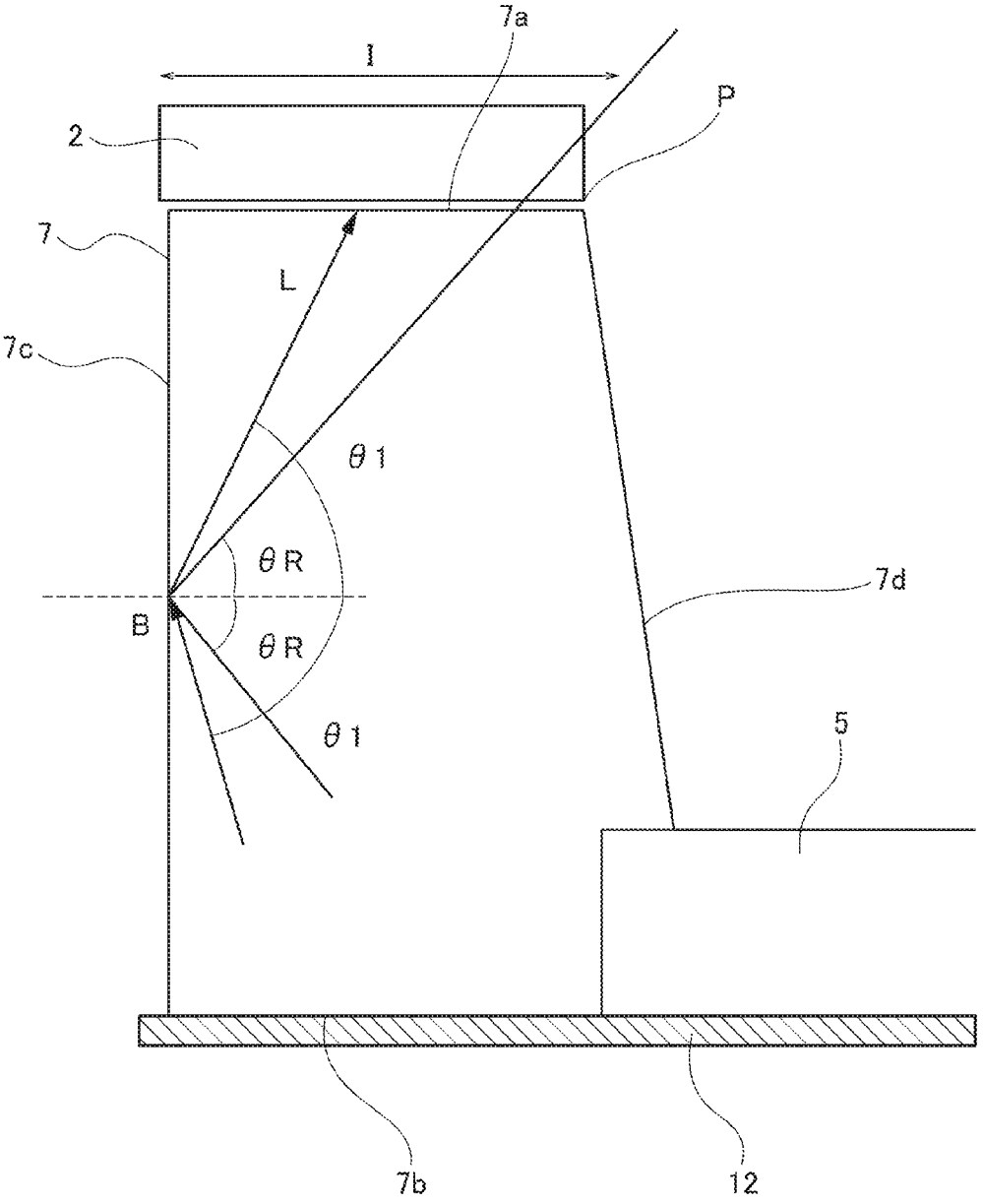
FIG. 8 is a view for explaining a critical angle of the non-inclined outside surface of the dial trim ring.

FIG. 7 is a view showing the dial trim ring according to the present invention in which the outside surface 7*c* inclines inward at an inclination angle θ with reference to the normal line H of the dial 5. FIG. 8 is a view showing a conventional dial trim ring in which the outside surface 7*c* does not incline. These dial trim rings differ only in the inclination angle of the outside surface.

θR shown in FIGS. 7 and 8 represents the critical angle at a point B on the outside surface 7*c* of the dial trim ring 7. The outside surfaces 7*c* in FIGS. 7 and 8 differ only in the inclination angle θ. The outside surfaces 7*c* in FIGS. 7 and 8 thus have the same critical angle θR to the normal line at the point B.

As shown in FIG. 7, the critical angle θR and the end portion P of the timepiece case 2 have therebetween a difference at an angle θK. As shown in FIG. 8, the end portion P of the timepiece case 2 is located within the range of the critical angle θR. In FIG. 7, the light at the reflection angle θ1 exceeding the critical angle θR reflects within the range that can be viewed from the oblique upward of the dial trim ring 7. In FIG. 8, although the length I of the timepiece case 2 that covers the upper surface 7*a* is the same as that in FIG. 7, the light L at the reflection angle θ1 exceeding the critical angle θR is blocked by the timepiece case 2.

FIG. 8 shows the light that travels from the different color member 12 to the outside surface 7*c* within the range of the critical angle θR and reflects from the outside surface 7*c* to emit inside the dial trim ring 7 from the outside surface 7*c* within the range of the critical angle θR. However, such a light has an incident angle and a reflection angle which are smaller than the critical angle θR of the outside surface 7*c*. The amount of light that reflects from the outside surface 7*c* is therefore very small, and thus, the amount of light that emits inside the dial trim ring 7 after being reflected from the outside surface 7*c* is also very small.

Accordingly, it is difficult for such a light to obtain an effect of viewing the dial trim ring 7 as the color of the different color member 12. As described above, within the range of the critical angle θR, most of the lights that are incident on the outside surface 7*c* from the different color member 12 permeate the outside surface 7*c*, and emit toward the solar cell 11. The lights therefore reflect from the solar cell 11, permeate the outside surface 7*c* and the inside surface 7*d* toward the viewer side. The color of the light-receiving surface of the solar cell 11 is thereby reflected, and the dial trim ring 7 is viewed as a dark color.

More specifically, as the light L at the critical angle θR going inside the dial trim ring 7 from the end portion P of the timepiece case 2, the light reflected the different color member 12 reaches to the viewer when looking at the outside surface 7*c* of the dial trim ring 7 from the oblique upward. This phenomenon occurs not only in the point B of the outside surface 7*c* but also in each point of the outside surface 7*c*. As shown in FIG. 5, by inclining the outside surface 7*c* of the dial trim ring 7 inward, the light L at the critical angle θR goes inside the dial trim ring 7 from the end portion P of the timepiece case 2.

The end portion P of the timepiece case 2 and the critical angle θR may have therebetween a difference depending on the shape of the dial trim ring 7 or the shape of the timepiece case 2 even in the dial trim ring 7 shown in FIG. 8 in which the outside surface 7*c* is vertical to the surface of the dial 5. In this case, although the outside surface 7*c* is vertical to the surface of the dial 5, the light from the different color member 12 reaches the viewer side within a small range when viewing the outside surface 7*c* of the dial trim ring 7 from the oblique upward. Under this condition, by inclining the outside surface 7*c* at the inclination angle θ, the color of the different color member 12 is viewed in a viewing range which is wide at the inclination angle θ.

The visibility of the color of the different color member 12 when viewing the dial trim ring 7 from the oblique upward is changed depending on the shape of the dial trim ring 7 or the range in which the timepiece case 2 covers the upper surface 7*a*. However, as long as the conditions except the inclination condition of the outside surface 7*c* are the same, the color of the different color member 12 can be viewed by inclining the outside surface 7*c* at the inclination angle θ easier than that which does not incline the outside surface.

As described above, by inclining the outside surface 7*c* of the dial trim ring 7 inside the dial trim ring 7, the amount of light that reaches the oblique upward without being blocked by the timepiece case 2 increases, and the dial trim ring 7 can be easily viewed as the color of the different color member 12 when viewing the dial trim ring 7 from the oblique upward.

Alternatively, a part of the light that reflects from the different color member 12 is incident on the light-receiving surface of the solar cell 11. The power generation amount sufficient for driving the timepiece can be therefore obtained. In one example, when a coloring member having a light permeability is provided in the inside surface 7*d* or the outside surface 7*c* of the dial trim ring 7, the light transmittance of the inside surface 7*d* or the outside surface 7*c* is lowered by the coloring member having a light permeability, and the amount of light that reaches the solar cell 11 is decreased. The power generation effect is also lowered. On the other hand, according to the dial trim ring 7 of this embodiment, it is not necessary to provide, in the outside surface 7*c* or the inside surface 7*d*, the coloring member having a light permeability that lowers a light transmittance. The amount of light that is incident on the light-receiving surface of the solar cell 11 can be therefore increased, and the power generation effect of the solar cell can be also improved.

The following Table 1 shows evaluation results of the external appearance of the dial trim ring 7 as viewed from the oblique upward at a plurality of viewing angles. The inclination angle θ of the outside surface 7*c* is set to 5 types of 10°, 15°, 20°, 25°, and 30° in the dial trim ring 7 and the timepiece case 2 that are molded by transparent polycarbonate resin, as shown in FIG. 5.

TABLE 1

Relationship between Inclination Angle θ and External Appearance

| θ | External Appearance | Overall Evaluation |
|---|---|---|
| 10° | x | Unusable |
| 15° | x | Unusable |
| 20° | Δ | Usable |

TABLE 1-continued

| Relationship between Inclination Angle θ and External Appearance | | |
|---|---|---|
| θ | External Appearance | Overall Evaluation |
| 25° | ○ | Most Usable |
| 30° | ● | Most Usable |

In addition, the viewing angle between the normal line and the surface of the dial 5 is set to three types of 15°, 45°, and 75°. The marks x, Δ, ○, and ● in Table 1 are based on the following determination standards.

x . . . It is difficult to view the color of the different color member 12 at the viewing angle of 45° or more.

Δ . . . It is difficult to view the color of the different color member 12 at the viewing angle of 75° or more.

○ . . . The color of the different color member 12 can be viewed at almost any viewing angle.

● . . . The color of the different color member 12 can be viewed at any viewing angle.

It is preferable for the inclination angle θ of the outside surface 7*c* to be 20° to 30° based on the result of Table 1. However, even though the inclination angle θ is 0° to 20°, the color of the different color member 12 can be viewed within the range of the viewing angle of less than 45° better than that at the inclination angle θ of 0° or below.

The dial trim ring 7 in which the outside surface 7*c* inclines inward at the inclination angle θ with reference to the normal line of the dial 5 can emit the light, which reflects from the different color member 12 and reflects from the outside surface 7*c* to reflect the color of the different color member 12, inside the dial trim ring 7 at the inclination angle θ. The dial trim ring 7 can be therefore viewed as the color of the different color member 12 without decoration. The decoration effect can be thus given to the dial trim ring 7. The dial trim ring 7 is molded by transparent resin having a light permeability. The light incident on the dial trim ring 7 can be thereby guided to the solar cell 11 disposed outside the dial trim ring 7, and the power generation amount sufficient for driving the timepiece can be therefore obtained.

Modified Example of Embodiment 1

Next, a modified example of the electric timepiece with the solar cell in the present invention will be described with reference to FIGS. 9A to 12. FIGS. 9A, 9B, 9C, and 9D show electric timepieces with solar cells each having a different shape of the outside surface 7*c* of the dial trim ring 7 according to the modified examples. The electric timepiece with the solar cell shown in each of FIGS. 9A to 9D differs from that shown in FIGS. 1 to 5 and 7 only in the shape of the outside surface 7*c* of the dial trim ring 7. The description for the other configurations will be omitted.

Figure 9A:
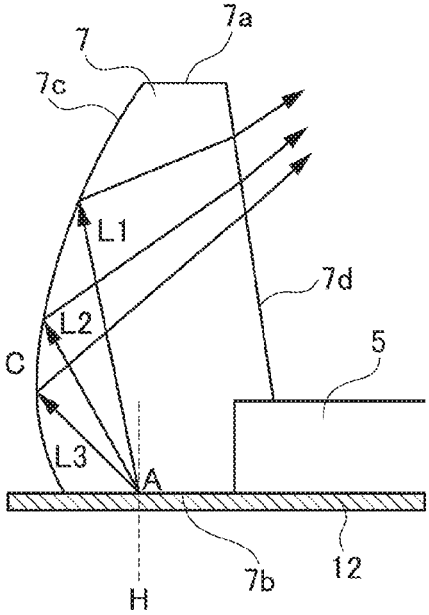
FIG. 9A is a view illustrating a modified example of the present invention in which the outside surface of the dial trim ring is formed into a curved surface.
Figure 9B:
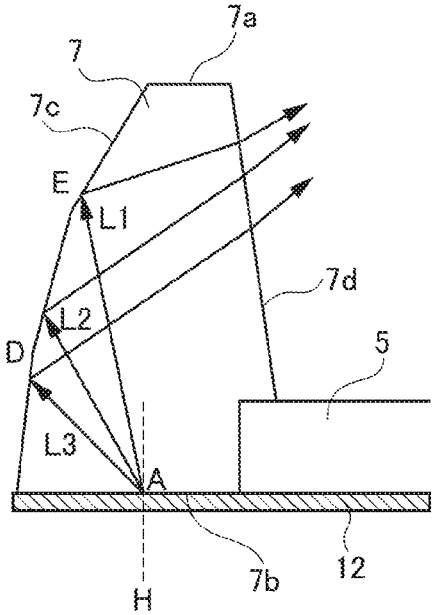
FIG. 9B is a view illustrating a modified example of the present invention in which a plurality of inclined surfaces each having a different inclination angle is formed in the outside surface of the dial trim rim.
Figure 9C:
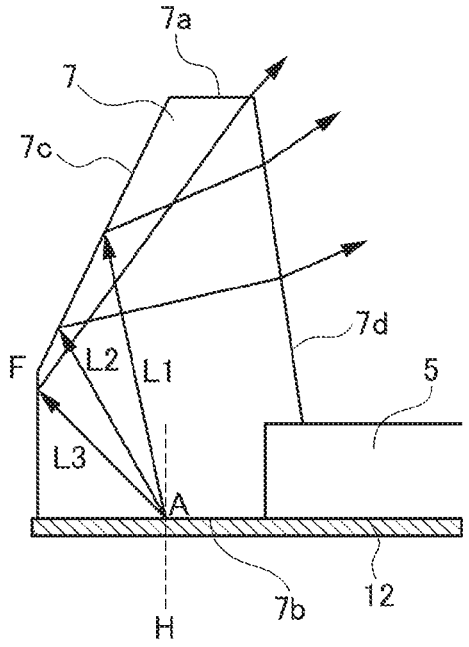
FIG. 9C is a view illustrating a modified example of the present invention in which the inclined surface is formed only in the upper portion of the outside surface of the dial trim ring.
Figure 9D:
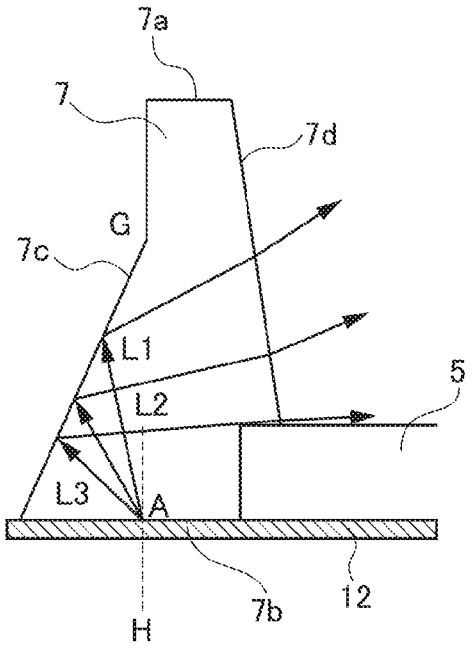
FIG. 9D is a view illustrating a modified example of the present invention in which the inclined surface is formed only in the lower portion of the outside surface of the dial trim ring.

FIG. 9A shows an example of the outside surface 7*c* inclined to have a curved surface which expands outside. FIG. 9B shows an example of the outside surface 7*c* formed of a plurality of inclination surfaces each having a different inclination angle. FIG. 9C shows an example in which an inclination surface is formed only in the upper portion of the outside surface 7*c*. FIG. 9D shows an example in which an inclination surface is formed only in the lower portion of the outside surface 7*c*.

The outside surface 7*c* of the dial trim ring 7 shown in FIG. 9A inclines outside the dial trim ring 7 from the lower surface 7*b* to a point C at a sectional height of about ⅓, and a part of the outside surface 7*c* above the point C inclines inside the dial trim ring 7. As described above, the lights L1 to L3 that reflect on the point A can be reflected from the outside surface 7*c* to emit inside the dial trim ring 7 even though the inclination surface of the outside surface 7*c* is formed of the curved surface. In particular, since the dial trim ring 7 shown in FIG. 9A includes the outside surface 7*c* having a curved surface, the reflection angle of the light on the outside surface 7*c* can be easily adjusted to concentrate the light reflected from the outside surface 7*c* within the range of the inside surface 7*d*.

The outside surface 7*c* of the dial trim ring 7 shown in FIG. 9B includes the three inclination surfaces each having a different inclination angle. The three inclination surfaces are the inclination surface from the lower surface 7*b* to a point D, the inclination surface from the point D to a point E, and the inclination surface from the point E to the upper surface 7*a*. In this example, the respective inclination surfaces are formed to have the relationship of the inclination angles θ such as the inclination surface from the lower surface 7*b* to the point D<the inclination surface from the point D to the point E<the inclination surface from the point E to the upper surface 7*a* with reference to the normal line H to the surface of the dial 5. All of the inclination surfaces incline inside the dial trim ring 7.

By forming the inclination surfaces each having a different inclination angle θ on the outside surface 7*c* as described above, the lights L1 to L3 reflected on the point A can be reflected from the outside surface 7*c* to emit inside the dial trim ring 7. Since the dial trim ring 7 shown in FIG. 9B includes the outside surface 7*c* having a shape similar to a curved surface, the reflection angle of the light on the outside surface can be easily adjusted to concentrate the light reflected from the outside surface 7*c* within the range of the inside surface 7*d*, similar to the dial trim ring 7 shown in FIG. 9A.

The dial trim ring 7 shown in FIG. 9C includes, in a part of the outside surface 7*c*, the inclination surface. A part of the outside surface 7*c* from the lower surface 7*b* to the point F does not incline (inclination angle θ=0 degree), and a part of the outside surface 7*c* from the point F to the upper surface 7*a* inclines. Namely, the inclination surface is not formed from the end portion of the outside surface 7*c* on the dial 5 side to the point F at a predetermined height in the outside surface 7*c*, and the inclination surface is formed from the point F at a predetermined height in the outside surface 7*c* to the end portion of the outside surface 7*c* on the side opposite to the dial 5 side.

By forming the inclination surface only in the upper portion of the outside surface 7*c* in section as described above, the lights L1 to L3 that reflect on the point A are reflected on the outside surface 7*c* to emit inside the dial trim ring 7. In particular, the dial trim ring 7 shown in FIG. 9C has a right angle between the lower surface 7*b* and the outside surface 7*c*. The lower end portion of the outside surface 7*c* of the dial trim ring 7 shown in FIG. 9C is thus stronger than that of the dial trim ring 7 shown in FIG. 5, for example, in which such an angle is within 90 degrees, thus improving shock resistance of the dial trim ring 7.

In addition, the dial trim ring 7 shown in FIG. 9C may be configured such that the vicinity of the end portion of the outside surface 7*c* on the side opposite to the dial 5 side does not incline as the dial trim ring 7 shown in FIG. 9D. Namely, in the dial trim ring 7 shown in FIG. 9C, the inclination surface is not formed from the end portion of the outside surface 7*c* on the dial 5 side to the point F at a predetermined height, and the inclination surface is formed in a part of the outside surface 7*c* from the point F at the predetermined height to the end portion of the outside surface 7*c* on the side opposite to the dial 5 side.

In the dial trim ring 7 shown in FIG. 9D, the inclination surface is formed in a part of the outside surface 7*c* of the dial trim ring 7. In the dial trim ring 7, the outside surface 7*c* inclines between the lower surface 7*b* and a point G while the outside surface 7*c* does not incline between the point G and the upper surface 7*a*.

Namely, the inclination surface is formed from the end portion of the outside surface 7*c* on the dial 5 side to the point G at a prescribed height while the inclination surface is not formed from the point G at the prescribed height to the end portion of the outside surface 7*c* on the side opposite to the dial 5 side. By forming the inclination surface only in the lower portion of the outside surface 7*c* in the sectional direction as described above, the lights L1 to L3 that reflect on the point A can be reflected from the outside surface 7*c* to emit inside the dial trim ring 7.

The dial trim ring 7 shown in FIG. 9D provides a visual effect in which the length from the dial 5 to the glass 4 can be seen shorter than the actual length.

By forming the shape of the inclination surface of the outside surface 7*c* as described above, the angle and the position of the light that reflects not only on the point A but also on each portion of the lower surface 7*b* to emit from the inside surface 7*d* can be precisely adjusted.

Figure 10A:
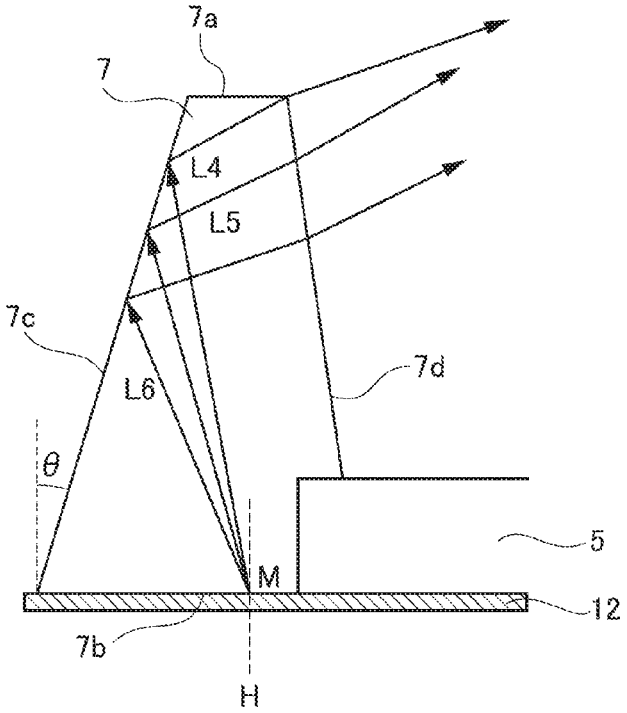
FIG. 10A is a view for explaining the path of light in the dial trim ring illustrated in FIG. 5 according to the present invention.
Figure 10B:
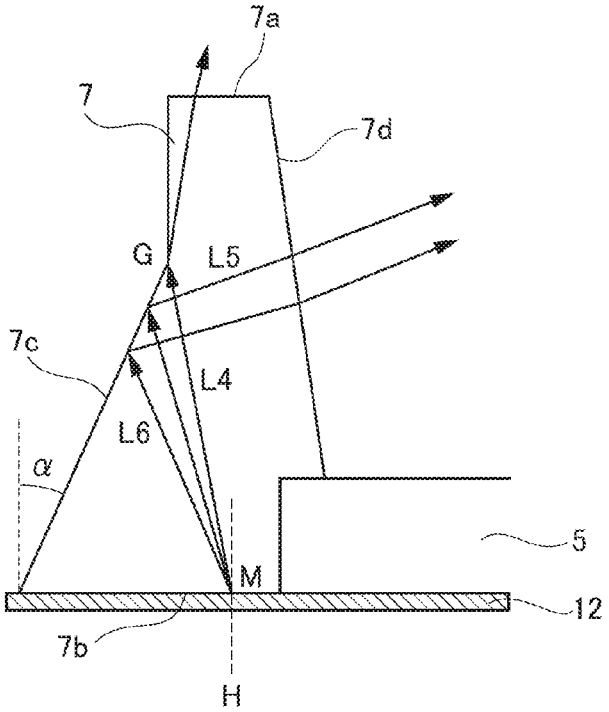
FIG. 10B is a view for explaining the path of light in the dial trim ring illustrated in FIG. 9D according to the present invention.

Next, the effect obtained by the dial trim ring 7 shown in FIG. 9D will be described in comparison with the dial trim ring shown in FIG. 5. FIG. 10A shows the paths of lights L4 to L6 that reflect from the different color member 12 on a point M of the lower surface 7*b* in the dial trim ring 7 shown in FIG. 5. FIG. 10B shows the paths of lights L4 to L6 that reflect from the different color member 12 on the point M of the lower surface 7*b* in the dial trim ring 7 shown in FIG. 9D.

The lights L4 to L6 reflect on the point M of the different color member 12 in different directions. In addition, the lights L4 to L6 that reflect on the point M are lights (not shown) that are incident on the point M from the outside of the dial trim ring 7. The emission angles between the lights L4, L5, and L6 that reflect on the point M and the normal line H to the surface of the different color member 12 have the relationship such as light L6>light L5>light L4.

The width of the upper surface 7*a* and the width of the lower surface 7*b* in FIG. 10B are the same as those in FIG. 10A. FIG. 10B shows a configuration in which the outside surface 7*c* inclines from the lower surface 7*b* to the point G, and the outside surface 7*c* does not incline from the upper surface 7*a* to the point G. The upper end of the inclination surface formed in the outside surface 7*c* in FIG. 10B is located closer to the dial 5 than that in FIG. 5. Thus, the inclination angle α of the outside surface 7*c* is larger than the inclination angle θ of FIG. 5.

Comparing the paths of the lights L4 to L6 in FIG. 10A with the paths of the lights L4 to L6 in FIG. 10B, the lights reflected from the inclination surface of the outside surface 7*c* in FIG. 10B emit from the inside surface 7*d* as the lights L5 and L6. On the other hand, the light reflected from the surface which does not incline from the upper surface 7*a* to the point G reflects in the direction of the upper surface 7*a*, and is blocked by the timepiece case 2 disposed in the upper surface 7*a* of the dial trim ring 7 as the light L4 in FIG. 10B. The amount of light that emits from the vicinity of the upper portion of the inside surface 7*d* of the dial trim ring 7 in FIG. 10B is less than that in FIG. 10A.

When viewing the inside surface 7*d* of the dial trim ring 7 shown in FIG. 10B, the upper portion of the dial trim ring 7 is darker than that in FIG. 10A. The dark upper portion of the dial trim ring 7 cannot be recognized as the dial trim ring 7, and the dial trim ring 7 is recognized to have a height shorter than an actual height (measurement). The visible effect in which the length (measurement) from the dial 5 to the glass 4 is seen to be shorter than the actual depth is therefore obtained.

In addition, the dial trim ring 7 shown in FIG. 10B has the inclination angle α of the inclination surface of the outside surface 7*c* larger than the inclination angle θ of the dial trim ring 7 shown in FIG. 10A. The light reflected from the inclination surface of the outside surface 7*c* therefore emits in the surface direction of the dial 5 from the position of the inside surface 7*d* lower than that in FIG. 10A, as the lights L5 and L6. The dark area is thereby increased in the vicinity of the upper portion of the dial trim ring 7, and the visible effect in which the length from the dial 5 to the glass 4 is seen to be shorter than the actual length can be further improved.

Figure 11:
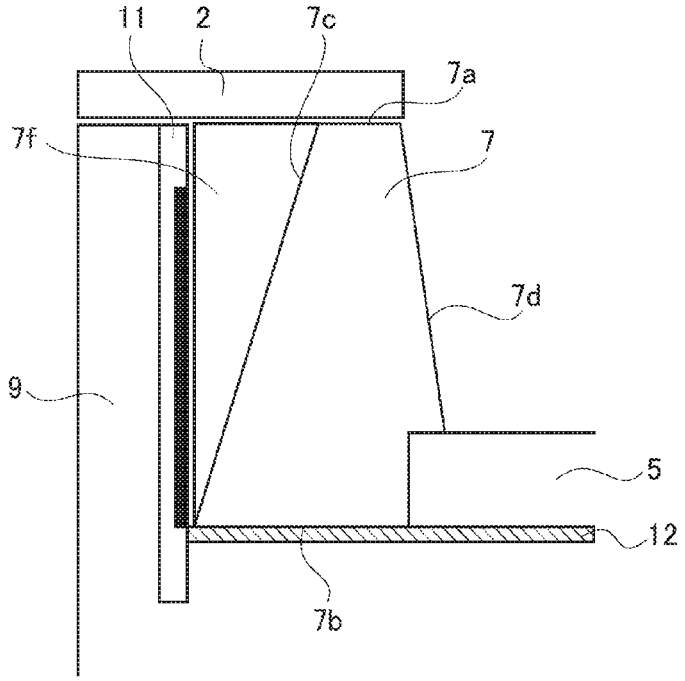
FIG. 11 is a view illustrating a modified example of the present invention in which a support convex portion is provided in the outside surface of the dial trim ring.

The electric timepiece with the solar cell shown in FIG. 11 differs from that shown in FIGS. 1 to 5 and 7 in that a supporting convex portion 7*f* is integrally formed in the dial trim ring 7. The description for the other configurations will be omitted. The supporting convex portion 7*f* protrudes toward the solar cell 11 from the outside surface 7*c* of the dial trim ring 7, and is formed in a plurality of positions such as 12, 3, 6, and 9 o'clock positions. The supporting convex portion 7*f* is formed into a plate having a predetermined thickness, and has, as seen from the side surface, a right triangle shape having a bottom facing the solar cell 11, an oblique side facing the outside surface 7*c*, and a sharp angle portion adjacent to the different color member 12.

The supporting convex portions 7*f* prevents the solar cell 11 from being deformed due to the impact from the side surface of the timepiece case 2, and projecting toward the dial trim ring 7. When the vertical damage is applied to the glass 4 and the back lid 3, for example, the supporting convex portions 7*f* also prevent the dial trim ring 7 from being destroyed by dispersing the impact applied to the dial trim ring 7 into a plurality of supporting convex portions 7*f*. The light reflected on the supporting convex portions 7*f* provided in the outside surface 7*c* is similar to the light reflected from the outside surface 7*c* which does not incline as shown in FIG. 6. When viewing the dial trim ring 7 from the oblique upward, the color of the portions provided with the supporting convex portions 7*f* differs from the other portion. The supporting convex portions 7*f* can be thus used as the information display showing 12 o'clock, 3 o'clock, 6 o'clock, and 9 o'clock.

Figure 12:
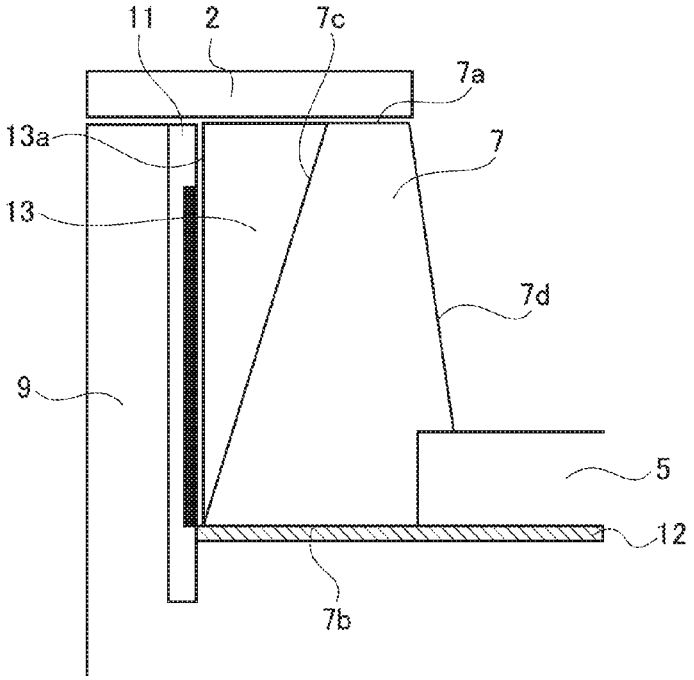
FIG. 12 is a view illustrating a modified example of the present invention in which a support member is provided between the solar cell and the outside of the dial trim ring.

The electric timepiece with the solar cell shown in FIG. 12 differs from that shown in FIGS. 1 to 5 and 7 only in that a ring 13 is disposed between the dial trim ring 7 and the solar cell. The description for other configurations will be omitted. The ring 13 is a transparent circular member disposed to surround the entire circumference of the outside surface 7*c* of the dial trim ring 7. The ring 13 has in section a right triangle shape having a bottom facing the solar cell 11, an oblique side facing the outside surface 7*c* as the inclination surface, and a sharp angle portion adjacent to the different color member 12. The surface of the ring 13 that faces the outside surface 7*c* is closely disposed on the outside surface 7*c*. A supporting surface 13*a* facing the solar cell 11 is closely disposed on the solar cell 11 or a small space is provided between the supporting surface 13*a* and the solar cell 11.

The ring 13 has a refractive index smaller than that of the dial trim ring 7. In one example, when the dial trim ring 7 is made of polycarbonate, the ring 13 can be made of acrylic resin having a refractive index smaller than that of the polycarbonate. It is necessary for the member that is closely disposed on the inclination surface formed in the outside surface 7*c* of the dial trim ring 7 to have a refractive index smaller than that of the dial trim ring 7, so as to reflect from the outside surface 7*c* the light incident on the outside surface 7*c* from the inside of the dial trim ring 7.

Namely, in this case, the ring 13 is provided between the inclination surface and the solar cell 11 as a member having a reflective index smaller than that of the dial trim ring 7. If the ring 13 is not closely disposed on the inclination surface formed in the outside surface 7*c* to have a small space between the ring 13 and the inclination surface, air is provided between the inclination surface and the solar cell 11 as a substance having a refractive index smaller than that of the dial trim ring 7.

In the electric timepiece with the solar cell shown in FIG. 12, the supporting surface 13*a* of the ring 13 prevents the solar cell 11 from being moved toward the dial trim ring 7 to protrude when the impact is applied to the electric timepiece with the solar cell shown in FIG. 12 from the side surface of the timepiece case 2. The ring 13 is made of a member having a refractive index different from that of the dial trim ring 7. The light incident on the outside surface 7*c* of the dial trim ring 7 from the inside of the dial trim ring 7 reflects from the outside surface 7*c* similar to the dial trim ring shown in FIG. 5. The critical angle of the outside surface 7*c* changes according to the refractive index of the ring 13.

Figure 13:
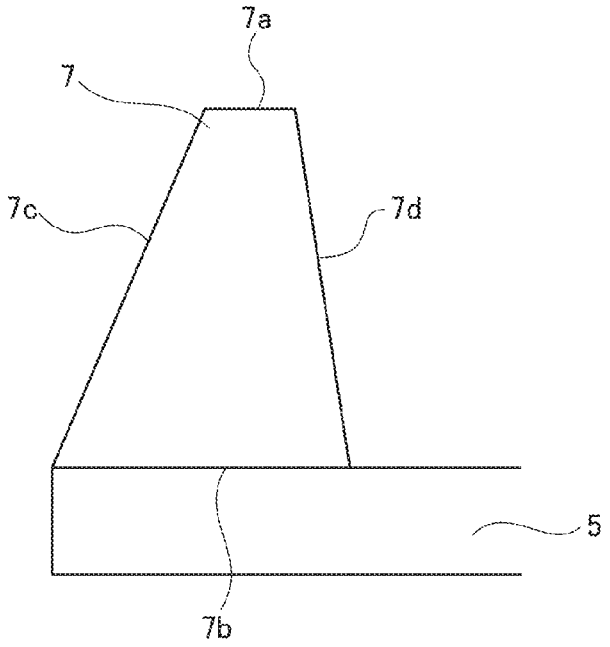
FIG. 13 is a view illustrating a modified example of the present invention in which a dial is disposed in a lower surface of the dial trim ring instead of a different color member.

FIG. 13 shows a modified example of the electric timepiece with the solar cell in which the dial trim ring 7 is placed on the dial 5.

The electric timepiece with the solar cell shown in FIG. 13 differs from that shown in FIGS. 1 to 5 and 7 only in that the lower surface 7*b* of the dial trim ring 7 is a flat surface, the outer circumference portion of the dial 5 extends to the lower end portion of the outside surface 7*c* of the dial trim ring 7, the lower surface 7*b* is placed on the surface of the dial 5, and the dial 5 is used as the different color member. The description for the other configurations will be omitted.

In this case, the dial 5 positioned under the dial trim ring 7 operates as the different color member. Accordingly, by desirably coloring a part of the dial 5 that faces the lower surface 7*b*, that color can be viewed when looking at the dial trim ring 7 from the oblique upward. The part of the dial 5 that faces the lower surface 7*b* and the other part of the dial 5 may be the same color.

In the present invention, it is preferable for the different color member 12 to closely abut on the lower surface 7*b* of the dial trim ring 7 as shown in FIG. 5, so as to reflect the color of the different color member 12 on the inside surface 7*d* of the dial trim ring 7. The reason will be hereinafter described with reference to FIG. 14. The electric timepiece with the solar cell shown in FIG. 14 differs from that in FIGS. 1, 5, and 7 in that the different color member 12 separates from the lower surface 7*b* of the dial trim ring 7. The description for the other configurations will be omitted.

Figure 14:
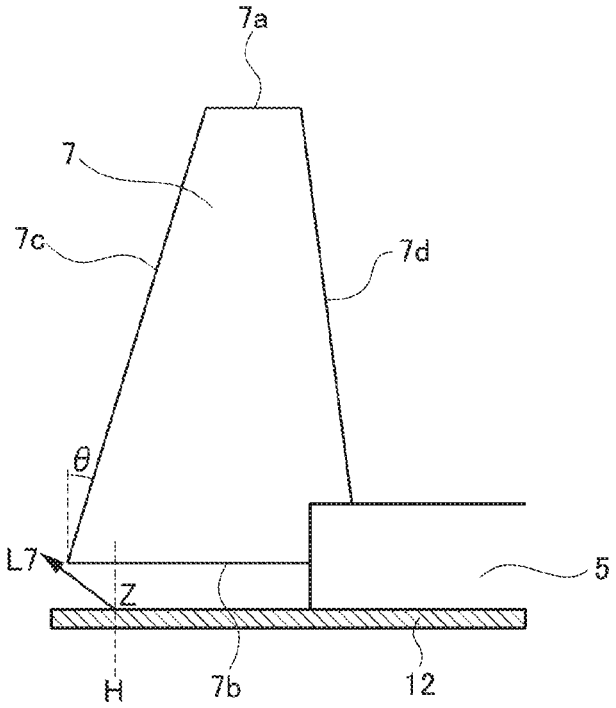
FIG. 14 is a view for explaining a path of light when the different color member is separated from the lower surface of the dial trim ring.

As shown in FIG. 14, when the lower surface 7*b* of the dial trim ring 7 separates from the different color member 12, the light reflects from the surface of the different color member 12, and emits outside the outside surface 7*c* from between the lower surface 7*b* of the dial trim ring 7 and the different color member 12 as a light L7 that reflects on a point Z close to the outside surface 7*c* of the dial trim ring 7. The amount of light that emits from the inside surface 7*d* of the dial trim ring 7 decreases in accordance with the amount of light that emits from between the lower surface 7*b* and the different color member 12. It becomes difficult for the light that emits from the inside surface 7*d* to reflect the color of the different color member 12. However, it is possible to adjust the amount of light that reflects the color of the different color member 12 by purposely separating the different color member 12 from the lower surface 7*b* of the dial trim ring 7.

When the lower surface 7*b* of the dial trim ring 7 is a smooth surface, the light that is incident from the outside of the dial trim ring 7 and reflects from the different color member 12 can best reflect the color of the different color member 12. When the surface of the lower surface 7*b* is a rough surface, the light that is incident on the lower surface 7*b* from the outside of the dial trim ring 7 is scattered, and hardly reflects from the outside surface 7*c*. The dial trim ring 7 may be clouded. However, the rough surface may be used for the lower surface 7*b* according to a target effect, or the light that reflects from the outside surface 7*c* may be purposely clouded.

The color of the different color member 12 is not limited to a single color. A plurality of colors may be used or gradation may be used.

When a line having a predetermined width that extends from the inside surface 7*d* side to the outside surface 7*c* side is drawn in the 12, 3, 6, and 9 o'clock positions on the different color member 12 with a color different from the other portion of the different color member 12, the line can be recognized as hour marks when looking at the dial trim ring 7 from the oblique upward. By partially differentiating the color of the different color member 12, indexes except the hour marks or information except the indexes for use in the electric timepiece with the solar cell may be displayed.

Moreover, the lower surface 7*b* may be formed into the inclination surface that inclines relative to the dial 5, and the different color member 12 may be disposed to be parallel to the inclination surface, so as to change the angle of the light that reflects toward the outside surface 7*c* from the lower surface 7*b*. The angle of the light that emits inside the dial trim ring 7 can be thereby controlled.

Gate for Molding Dial Trim Ring

Figure 15A:
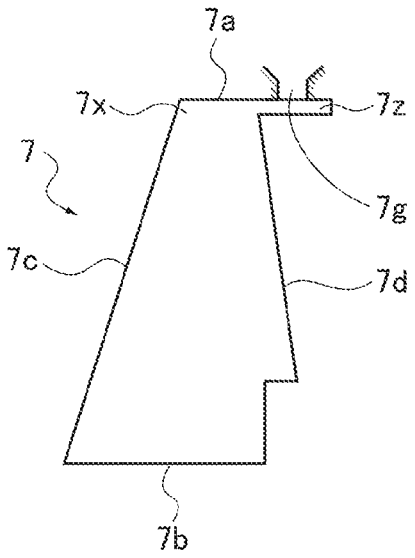
FIG. 15A is a view illustrating an example of an installation position of a gate as an inlet of a material when molding the dial trim ring illustrated in FIGS. 2 to 5 with injection molding, and FIG. 15A corresponds to FIG. 5.
Figure 15B:
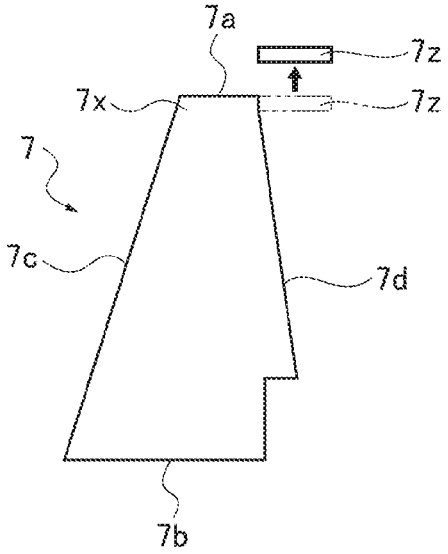
FIG. 15B is a view illustrating the dial trim ring illustrated in FIG. 15A from which a flange is removed.

FIG. 15A is a view showing one example of an installation position of a gate 7*g* as an inlet of a material when molding the dial trim ring 7 shown in FIGS. 2 to 7 with injection molding. FIG. 15A corresponds to FIG. 5. FIG. 15B is a view showing the dial trim ring 7 shown in FIG. 15A from which a flange 7*z* is removed. The dial trim ring 7 according to the above embodiment and the modified examples has the outside surface 7*c* that inclines inward. The width of the upper surface 7*a* of the dial trim ring 7 in the radial direction is therefore shorter than that of the lower surface 7*b*, as shown in FIG. 5.

The conventional dial trim ring has an outside surface that does not incline inward. The upper surface and the lower surface of the conventional dial trim ring therefore have the same width. A gate required for the injection molding is provided on the upper surface. As shown in FIG. 2, since the upper surface is covered by the timepiece case 2, the scar left by the gate can be covered. The external appearance quality can be therefore prevented from being lowered. The other surfaces such as the inside surface 7*d*, the outside surface 7*c*, and the lower surface 7*b* are surfaces to be viewed, emission surfaces, or reflection surfaces of the light L. When the gate is provided in the portion where the scar left on the gate becomes prominent or the portion where an unevenness color due to the path of the light becomes prominent, the quality of the external appearance of the dial trim ring 7 is lowered.

The dial trim ring 7 according to the present embodiment includes the upper surface 7*a* having a short width as described above. It may be thus difficult to directly dispose the gate on the upper surface 7*a*. As shown in FIG. 15A, the dial trim ring 7 according to the present embodiment includes a flange 7*z* extending inward in the radial direction from an upper portion 7*x* including the upper surface 7*a*. The gate 7*g* can be provided in this flange 7*z*. In this case, as shown in FIG. 15A, the dial trim ring 7 including in the upper portion 7*x* thereof the flange 7*z* is formed. After that, by eliminating the flange 7*z* as shown in FIG. 15B, the dial trim ring 7 according to the present embodiment can be formed.

Figure 16A:
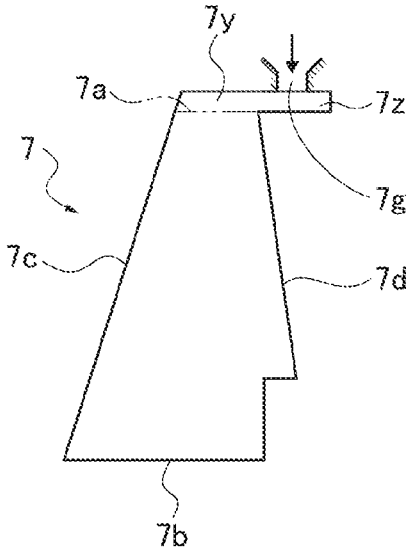
FIG. 16A is a view illustrating another example of the installation position of the gate as the inlet of the material when molding the dial trim ring illustrated in FIGS. 2 to 5 with injection molding, and FIG. 16A corresponds to FIG. 5.
Figure 16B:
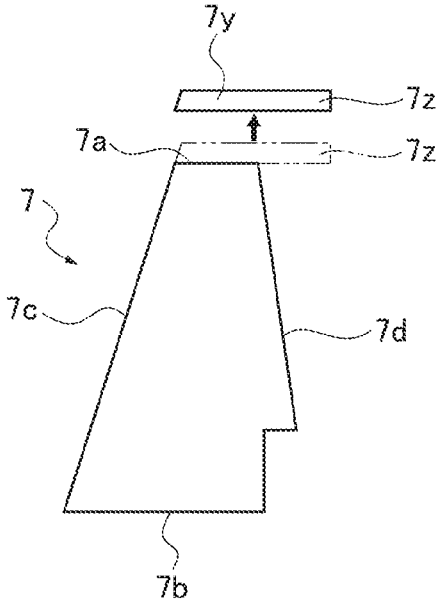
FIG. 16B is a view illustrating the dial trim ring illustrated in FIG. 16A from which an extended portion and the flange are removed.

FIG. 16A is a view showing another example of the installation position of the gate 7*g* as the inlet of the material for molding the dial trim ring 7 shown in FIGS. 2 to 5 with the injection molding. FIG. 16A corresponds to FIG. 5. FIG. 16B is a view showing the dial trim ring 7 shown in FIG. 16A from which an extended portion 7*y* and the flange 7*z* are removed. As shown in FIG. 16A, the dial trim ring 7 according to the present embodiment includes the extended portion 7*y* in which the upper surface 7*a* extends in the height direction, the flange 7*z* extending inward in the radial direction from the extended portion 7*y*, and the gate 7*g* provided on the flange 7*z*. In this case, as illustrated in FIG. 16A, the dial trim ring 7 including the extended portion 7*y* and the flange 7*z* is formed. After that, by removing the extended portion 7*y* and the flange 7*z*, as shown in FIG. 16B, the dial trim ring 7 according to the present embodiment can be formed.

Even if a small scar remains in the upper end portion of the inside surface 7*d* of the dial trim ring 7 after removing the flange 7*z*, the timepiece case 2 is provided just above the small scar. The scar mark is thus hardly distinguished. The inside surface 7*d* of the dial trim ring 7 can be vertically formed to coincide with the normal line of the dial 5, so as to easily remove the flange 7*z*.

Figure 17:
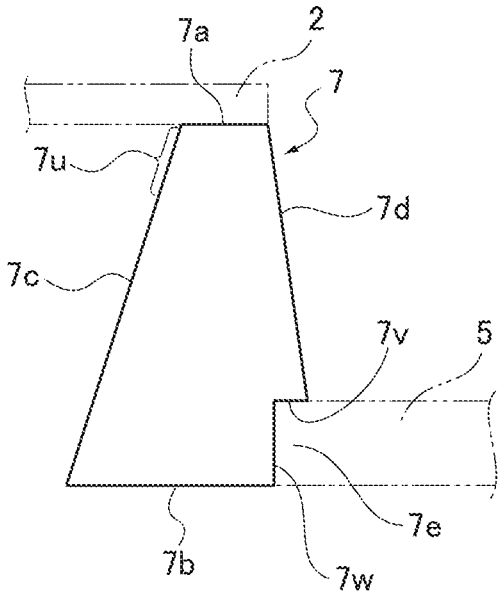
FIG. 17 is a view illustrating another example of the installation position of the gate, and FIG. 17 corresponds to FIG. 15.

FIG. 17 is a view showing another example of the installation position of the gate 7*g*. FIG. 17 corresponds to FIG. 15. The installation position of the gate 7*g* required for molding the dial trim ring 7 is not limited to the examples shown in FIGS. 15 and 16. More specifically, since the gate 7*g* is covered by the timepiece case 2, the gate 7*g* may be installed in an upper portion 7*u* of the outside surface 7*c* that does not contribute much to the reflection, as shown in FIG. 17. When a surface facing surface 7*v* facing the surface of the dial 5 in the concave portion 7*e* in which the outer circumference portion of the dial 5 is placed is long, the gate 7*g* may be installed in the surface facing surface 7*v*. Similarly, when an end surface facing surface 7*w* facing an outer circumference end surface of the dial 5 in the concave portion 7*e* in which the outer circumference portion of the dial 5 is placed is long, the gate 7*g* may be installed in the end surface facing surface 7*w*.

Embodiment 2

The dial trim ring 7 in Embodiment 1 shows an example in which the entire or a part of the outside surface 7*c* inclines inside the dial 5 (inclination angle $\theta>0$ degree). However, the dial trim ring of the electric timepiece with the solar cell of the present invention is not limited to Embodiment 1. More specifically, the light incident on the inside of the dial trim ring 7 from the inside surface 7*d* of the dial trim ring 7 reflects from the two surfaces of the lower surface 7*b* and the outside surface 7*c* in the inside of the dial trim ring 7 to emit from the inside surface 7*d*. In Embodiment 1, by inclining the outside surface 7*c* as the reflection surface at the inclination angle $\theta$, the angle between the two reflection surfaces (outside surface 7*c* and lower surface 7*b*) is set to the sharp angle of $(90-\theta)$ degree.

Figure 18:
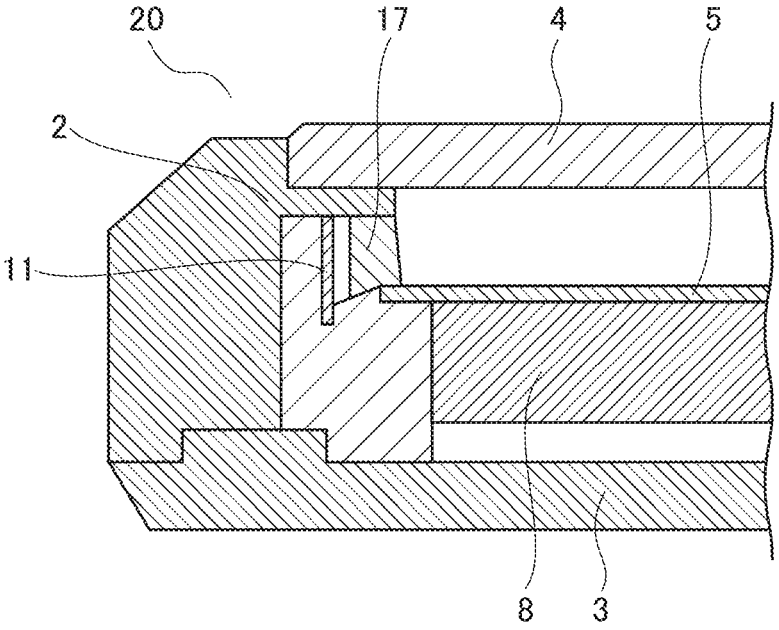
FIG. 18 is a view illustrating an electric timepiece with a solar cell according to Embodiment 2 of the present invention, and FIG. 18 corresponds to FIG. 2.
Figure 19:
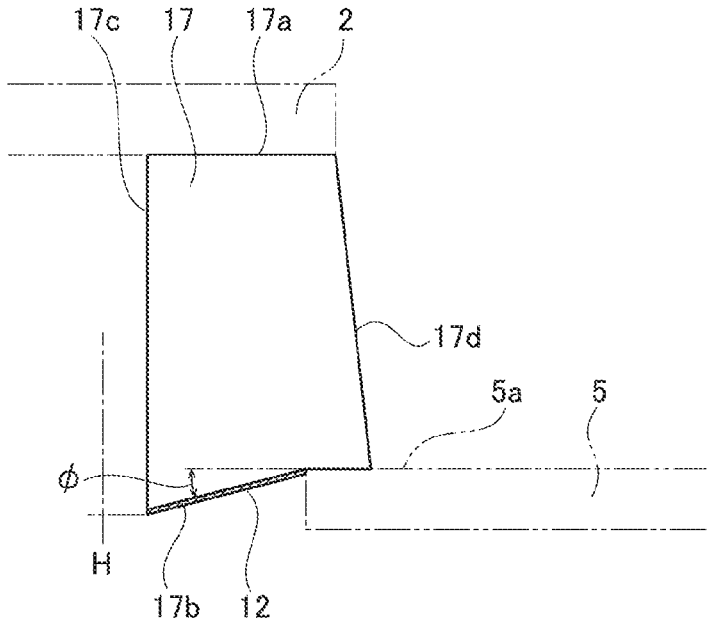
FIG. 19 is a view illustrating a dial trim ring in the electric timepiece with the solar cell illustrated in FIG. 18, and FIG. 19 corresponds to FIG. 5.

Accordingly, the dial trim ring of the present invention can solve the problem by setting the angle between the two reflection surfaces to the sharp angle. In the dial trim ring of the present invention, the lower surface of the two reflection surfaces may be inclined or both of the reflection surfaces may be inclined. FIG. 18 is a view showing an electric timepiece with a solar cell 20 according to Embodiment 2 of the present invention. FIG. 18 corresponds to FIG. 2. FIG. 19 is a view showing a dial trim ring 17 in the electric timepiece with the solar cell 20 shown in FIG. 18. FIG. 19 corresponds to FIG. 5. Although the electric timepiece with the solar cell 20 shown in FIG. 18 includes a dial trim ring 17 different from the dial trim ring 7 of the electric timepiece with the solar cell 1 in Embodiment 1, the other configurations of the electric timepiece with the solar cell in Embodiment 2 are basically the same as those in Embodiment 1. Thus, the description for the same configurations will be omitted.

As shown in FIG. 19, an outside surface 17*c* of the dial trim ring 17 in Embodiment 2 is vertically formed to coincide with the normal line H of the dial 5. Namely, the inclination angle $\theta$ (refer to FIG. 5) of the entire outside surface 17*c* of the dial trim ring 17 is 0 degree. On the other hand, a lower surface 17*b* as a part of the bottom of the dial trim ring 17 inclines downward in the height direction of the dial trim ring 7 as going from the center portion of the dial 5. The inclination angle $\phi$ (second angle) of the lower surface 17*b* is a constant value exceeding 0 degree. The lower surface 17*b* is formed from the side surface of the outer circumference of the dial 5 to the outside surface 17*c*.

The lower surface 17*b* is therefore located lower than the surface (front) 5*a* of the dial 5, as shown in FIG.19. The sum of the inclination angle $\theta$ and the inclination angle $\phi$ exceeds 0 degree. As a result, the angle between the two reflection surface (outside surface 17*c* and lower surface 17*b*) of the light in the inside of the dial trim ring 17 is set to a sharp angle of $(90-(\phi+\theta)=90-\phi)$ degree.

The different color member 12 is provided in the lower surface 17*b* to face the lower surface 17*b* from the outside.

Figure 20:
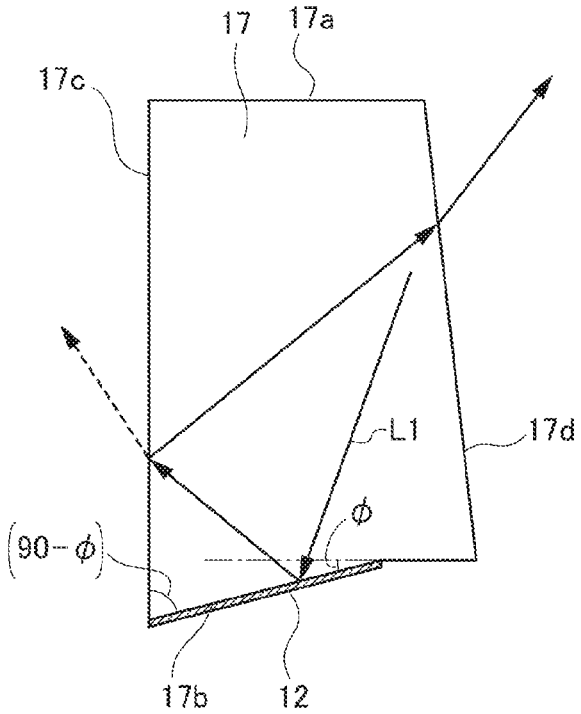
FIG. 20 is a schematic view illustrating a traveling direction of light when the light is incident inside the dial trim ring from an inside surface of the dial trim ring.

FIG. 20 is a schematic view showing the traveling direction of the light L1 when the light L1 is incident on the inside of the dial trim ring 17 from the inside surface 17*d* of the dial trim ring 17. As described in Embodiment 1, the light L1 incident on the dial trim ring 17 from the inside surface 17*d* includes the light that permeates the lower surface 17*b* and reflects from the different color member 12 to reflect the color of the different color member 12 and the light that reflects from the lower surface 17*b* to reflect no color of the different color member. The ratio of the light that reflects from the different color member 12 increases in accordance with a decrease in the incident angle to the lower surface 17*b* while the ratio of the light that reflects from the lower surface 17*b* increases in accordance with an increase in the incident angle to the lower surface 17*b*.

Both of the light reflected from the different color member 12 and the light reflected from the lower surface 17*b* are incident on the outside surface 17*c*. When the angle between the outside surface 17*c* and the lower surface 17*b* is set to a sharp angle and the inclination angle of the outside surface 17*c* is 0 degree, the incident angle of the light that reflects from the different color member 12 or the lower surface 17*b* to be incident on the outside surface 17*c* is decreased to be smaller than that of the conventional case in which the angle is set to the right angle, namely, the lower surface 17*b* does not inclines. The angle of the light that reflects from the outside surface 17*c* is therefore decreased, and thus, the light reflected from the outside surface 17*c* travels to the inside surface 17*d* without traveling to the upper surface 17*a*. This function becomes remarkable in accordance with an increase in the incident angle to the outside surface 17*c*. The incident angle to the outside surface 17*c* is increased in accordance with a decrease in the incident angle to the lower surface 17*b*. The light that reflects the color of the different color member 12 easily emit from the inside surface 17*d*.

On the other hand, the incident angle to the outside surface 17*c* is decreased in accordance with an increase in the incident angle to the lower surface 17*b*. The light that reflects no color of the different color member 12 permeates the outside surface 17*c* to contribute to the power generation by the solar cell 11 (refer to FIG. 18). Accordingly, the dial trim ring 17 achieves the function and effect similar to those of the dial trim ring 7 in Embodiment 1. Namely, the light that reflects from the different color member 12 to be incident on the outside surface 17*c* reflects toward the inside surface 17*d* to emit inside the dial trim ring 17.

In addition, the lower surface 17*b* positioned lower than the surface 5*a* of the dial 5 increases the height direction length from the glass 4 to the surface 5*a* of the dial 5 on the outside surface 17*c* side of the dial trim ring 17 to be larger than the appearance height direction length from the glass 4 to the surface 5*a* of the dial 5. The amount of light to be supplied to the solar cell 11 can be therefore increased.

Modified Example of Embodiment 2

Figure 21:
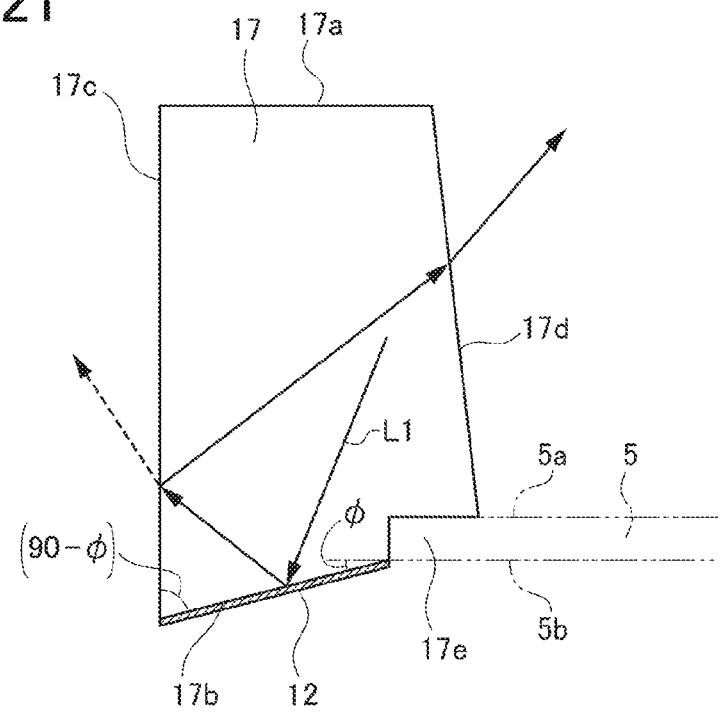
FIG. 21 is a view illustrating a modified example of the dial trim ring in which a concave portion is formed in a bottom.

FIG. 21 is a view showing a dial trim ring 17 of a modified example in which a concave portion 17*e* is formed in a bottom. In the dial trim ring 17 shown in FIGS. 18 to 20, the inside end portion of the lower surface 17*b* of the bottom is positioned at the same height as the surface 5*a* of the dial 5. However, the concave portion 17*e* similar to the concave portion 7*e* of the dial trim ring 7 in Embodiment 1 may be formed in the bottom. The outer circumference portion of the dial 5 is housed in the concave portion 17*e* of the dial trim ring 17, as shown in FIG. 21.

The concave portion 17*e* has a depth corresponding to the thickness of the dial 5 in the height direction of the dial trim ring 17. The inside end portion of the lower surface 17*b* of the dial trim ring 17 of the modified example is positioned at the same height as that of the rear surface 5*b* of the dial 5. The basic configurations of the inclination of the lower surface 17*b* and the sharp angle between the lower surface 17*b* and the outside surface 17*c* in the dial trim ring 17 of the modified example are the same as those in the dial trim ring 17 of Embodiment 2. In the dial trim ring 17 of the modified example, the light that reflects from the different color member 12 to be incident on the outside surface 17*c* emits inside the dial trim ring 7.

The lower surface 17*b* positioned lower than the rear surface 5*b* of the dial 5 further increases the height direction length from the glass 4 to the surface 5*a* of the dial 5 on the outside surface 17*c* side of the dial trim ring 17 to be larger than the apparent height direction length from the glass 4 to the surface 5*a* of the dial 5. The amount of light that is supplied to the solar cell 11 can be further increased.

FIGS. 22A, 22B, 22C, and 22D are views showing modified examples of the electric timepiece with the solar cell having a different shape of the lower surface 17*b* of the dial trim ring 17. The dial trim ring 17 in the electric timepiece with the solar cell shown in FIGS. 22A to 22D differs from that shown in FIG. 21 only in the shape of the lower surface 17*b* of the dial trim ring 17. The description of the other configurations will be omitted.

Figure 22A:
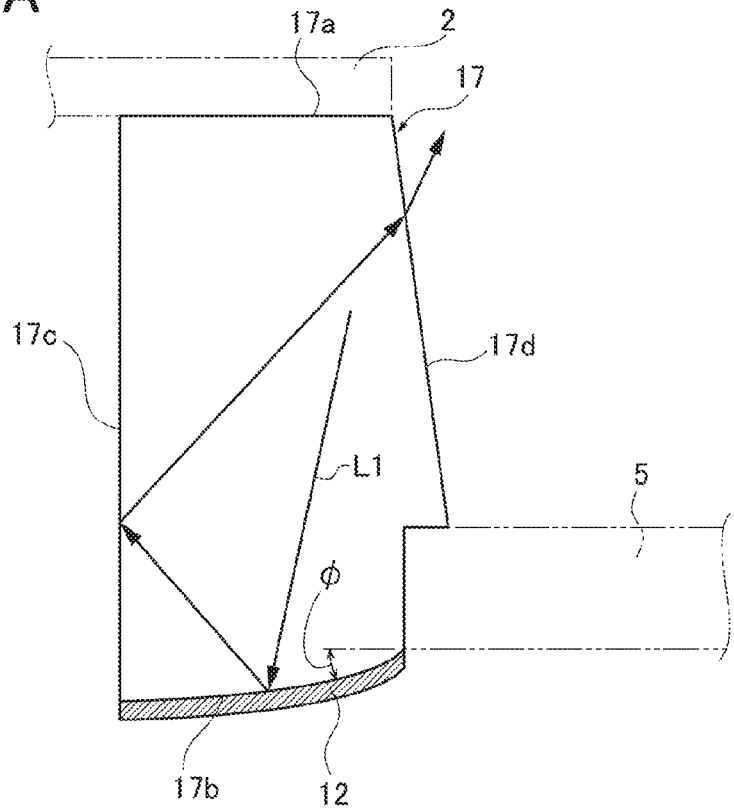
FIG. 22A is a view illustrating a modified example (part 1) of an electric timepiece with a solar cell having a different lower surface of a dial trim ring.
Figure 22B:
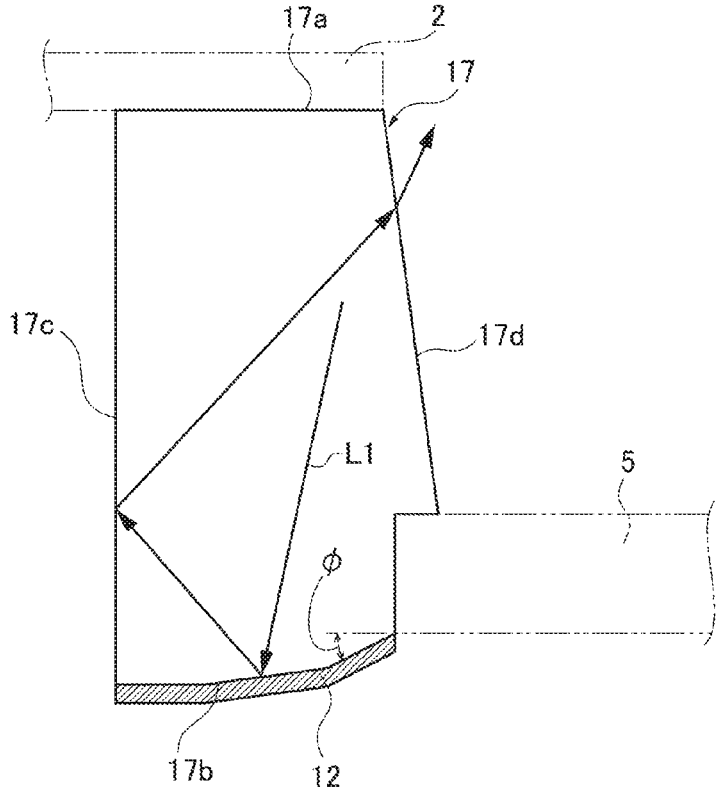
FIG. 22B is a view illustrating a modified example (part 2) of an electric timepiece with a solar cell having a different lower surface of a dial trim ring.
Figure 22C:
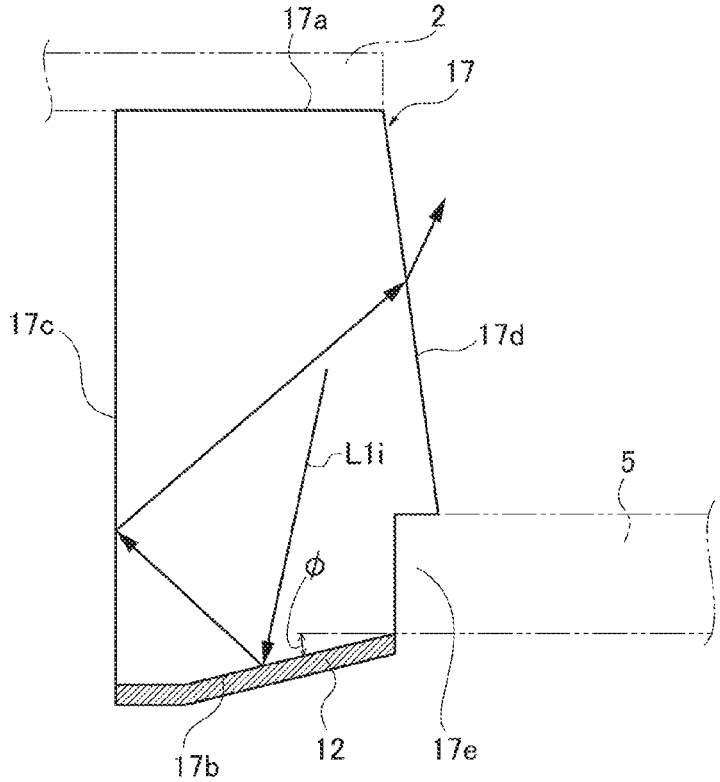
FIG. 22C is a view illustrating a modified example (part 3) of an electric timepiece with a solar cell having a different lower surface of a dial trim ring.
Figure 22D:
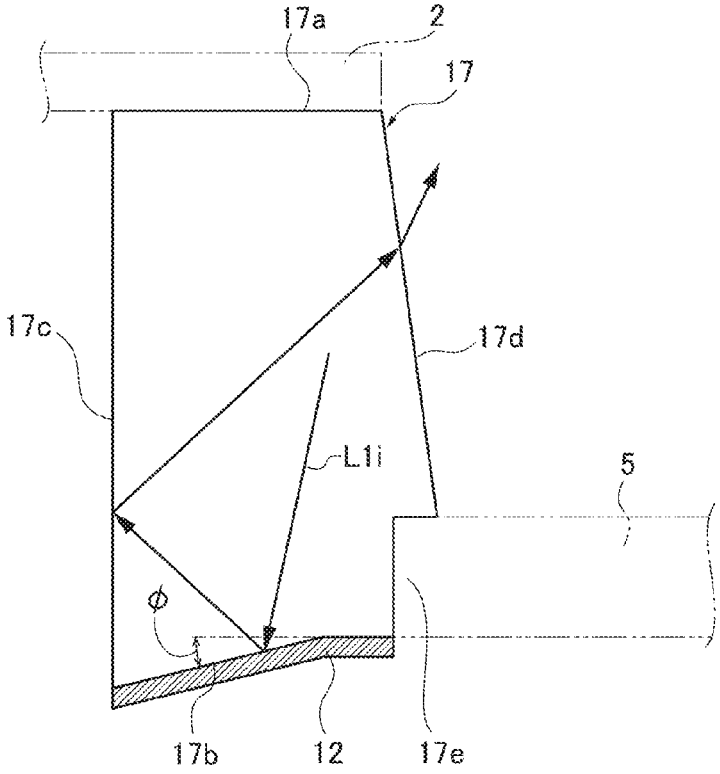
FIG. 22D is a view illustrating a modified example (part 4) of an electric timepiece with a solar cell having a different lower surface of a dial trim ring.

FIG. 22A shows an example in which the lower surface 17*b* is inclined to have a curved surface shape that swells downward. FIG. 22B shows an example in which the lower surface 17*b* includes a plurality of inclination surfaces each having a different inclination angle. FIG. 22C shows an example in which an inclination surface is formed only in the inside portion of the lower surface 17*b*. FIG. 22D shows an example in which an inclination surface is formed only in the outside portion of the lower surface 17*b*.

The dial trim ring 17 shown in FIG. 22A is formed of a curved surface of which an inclination angle $\phi$ of the lower surface 17*b* gradually decreases from the inside to the outside. In the dial trim ring 17 having such a lower surface 17*b*, the incident angle to the lower surface 17*b* decreases as the position in the lower surface 17*b* on which the light L1 incident from the inside surface 17*d* reflects shifts to the outside (close to outside surface 17*c*), and thus, the ratio of the light that reflects from the different color member 12 increases.

The incident angle of the light reflected from the different color member 12 to the outside surface 17*c* also increases as the position in the lower surface 17*b* on which the light L1 reflects shifts to the outside (close to outside surface 17*c*). Accordingly, the reflection position on the outside surface 17*c* shifts upper than that when the inclination angle $\phi$ of the lower surface 17*b* does not decrease from the inside to the outside. The reflection angle of the light can be thereby adjusted to concentrate, on the upper portion of the inside surface 17*d*, the range within which the light reflected from the different color member 12 emits from the inside surface 17*d*.

The dial trim ring 17 shown in FIG. 22B has the lower surface 17*b* formed of three inclination surfaces of which the inclination angle $\phi$ sequentially decreases from the inside to the outside. In the dial trim ring 17 including such a lower surface 17*b*, the inclination angle to the lower surface 17*b* decreases as the position in the lower surface 17*b* on which the light L1 incident from the inside surface 17*d* reflects shifts to the outside (close to outside surface 17*c*) having a small inclination angle $\phi$, and thus, the ratio of the light that reflects from the different color member 12 increases.

The incident angle of the light reflected from the different color member 12 to the outside surface 17*c* increases as the position in the lower surface 17*b* on which the light L1 reflects shifts to the outside (close to the outside surface 17*c*). The reflection angle of the light can be thereby easily adjusted to concentrate, on the upper portion of the inside surface 17*c*, the range within which the light reflected from the different color member 12 emits from the inside surface 17*d*.

The dial trim ring 17 shown in FIG. 22C includes the lower surface 17*b* having an outside portion (from the outer circumference end portion to the position in a predetermined length) that does not incline and an inside portion (from the position in the predetermined length to the concave portion 17*e*) that inclines at the inclination angle $\phi$ (>0 degree). In the dial trim ring 17 having such a lower surface 17*b*, the outside portion of the lower surface 17*b* and the outside surface 17*c* cross at the right angle. The corner portion has strength stronger than those in the other modified examples having the sharp angle. The impact resistance of the dial trim ring 17 is therefore improved.

In addition, as the dial trim ring 17 shown in FIG. 22D, the dial trim ring 17 shown in FIG. 22C may have the lower surface having the non-inclined inside portion near the dial 5. Namely, the dial trim ring 17 shown in FIG. 22C includes the lower surface 17*b* having, in the portion from the outside end portion to the position in a predetermined length, the non-inclined surface and at least in a portion inside the non-inclined surface, the inclined surface.

The dial trim ring 17 shown in FIG. 22D includes the lower surface 17*b* having a non-inclined inside portion (inclination angle $\phi$=0 degree) and an outside inclined portion near the outside surface 17*c* having an inclination angle $\phi$ (>0 degree). The dial trim ring 17 shown in FIG. 22D includes the inclination range having the inclination angle $\phi$ which is narrower than that of the dial trim ring 17 shown in FIG. 21. When the lower end portion of the outside surface 17*c* in the dial trim ring 17 shown in FIG. 22D is positioned at the same height as the dial trim ring 17 shown in FIG. 21, the dial trim ring 17 shown in FIG. 22D has the inclination angle of the lower surface 17*b* larger than that in FIG. 21.

In the dial trim ring 17 having such a lower surface 17*b*, when the light L1 incident from the inside surface 17*d* reflects from the inside portion of the lower surface 17*b* at the inclination angle $\phi$ of 0 degree, the inclination angle to the lower surface 17*b* decreases, and the light reflects toward the upper portion of the outside surface 17*c*. Since the light incident on the upper portion of the outside surface 17*c* at a large inclination angle reaches the upper surface 17*a*, such a light does not emit from the inside surface 17*d*.

On the other hand, when the light L1 incident from the inside surface 17*d* reflects from the outside portion of the lower surface 17*b* at the inclination angle $\phi$ (>0), the incident angle of the light reflected from the different color member 12 to the outside surface 17*c* decreases to be smaller than that of the dial trim ring 17 shown in FIG. 21, the reflection position on the outside surface 17*c* shifts downward, and the reflection angle of the light that reflects from the outside surface 17*c* decreases. Accordingly, the light mainly emits from the lower portion of the inside surface 17*d* after being reflected from the outside surface 17*c*.

The amount of light that emits from the upper portion of the inside surface 17*d* of the dial trim ring 17 shown in FIG. 22D decreases as described above, so that the upper portion of the dial trim ring 17 darkens, and the darkened upper portion cannot be recognized as the dial trim ring 17. The dial trim ring 17 is seen to have a height lower than an actual height. The visual effect in which the length from the dial 5 to the glass 4 can be seen shorter than the actual length can be thereby obtained.

Embodiment 3

Figure 23:
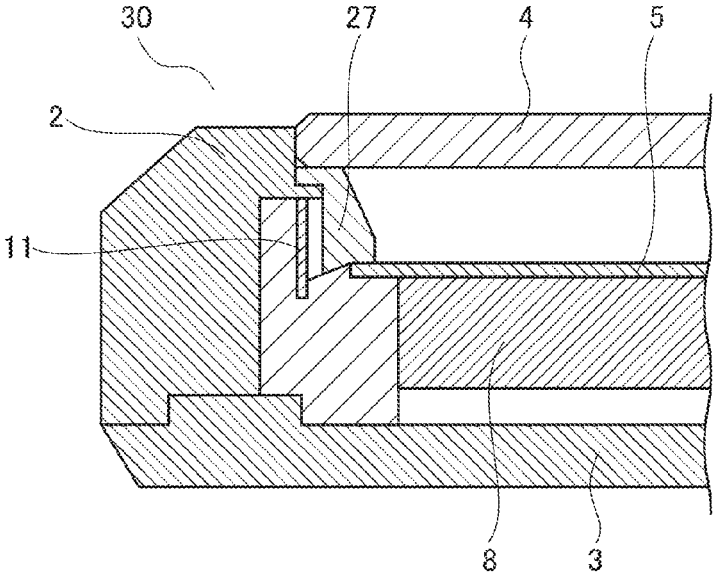
FIG. 23 is a view illustrating a part of an electric timepiece with a solar cell according to Embodiment 3 of the present invention, and FIG. 23 corresponds to FIG. 2.
Figure 24:
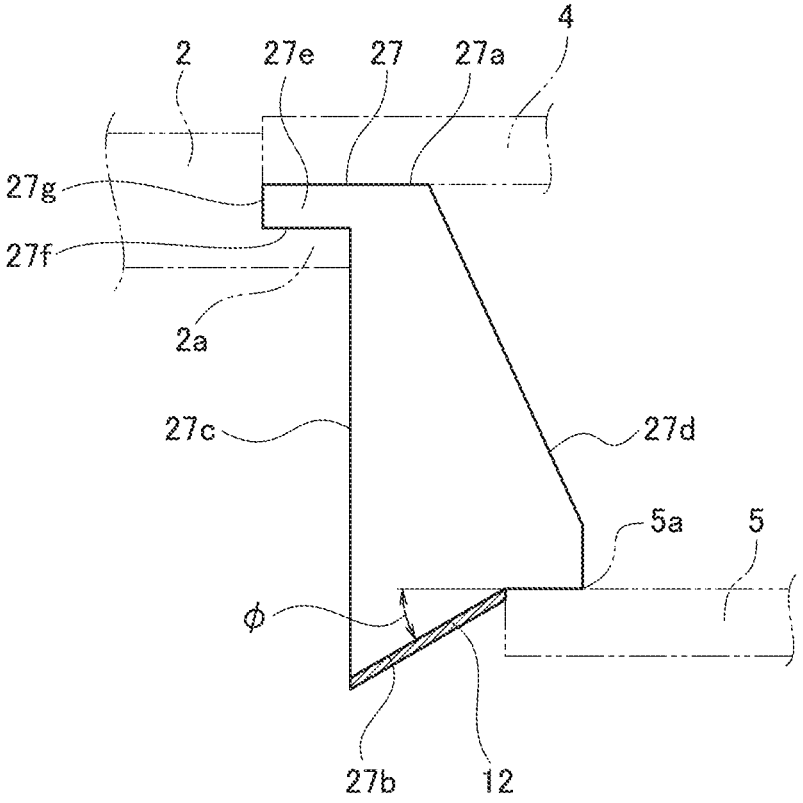
FIG. 24 is a view illustrating details of the dial trim ring in FIG. 23.

The dial trim rings 7 and 17 according to Embodiments 1 and 2 and the respective modified examples are formed into the shape in which the timepiece case 2 is disposed on the upper surfaces 7*a* and 17*a* (refer to FIGS. 4 and 19), as shown in FIGS. 2 and 18. However, the dial trim ring in the electric timepiece with the solar cell according to the present invention is not limited to Embodiments 1 and 2 and the modified examples. FIG. 23 is a view showing a part of an electric timepiece with a solar cell 30 including a dial trim ring 27 according to Embodiment 3. FIG. 24 is a view showing the details of the dial trim ring 27 shown in FIG. 23. The dial trim ring 27 shown in FIGS. 23 and 24 includes a flange 27*e*. The flange 27*e* includes an upper portion having an upper surface 27*a* that extends outside an outside surface 27*c* in the radial direction, and protrudes from the outside surface 27*c*, with respect to the dial trim ring 17 shown in FIG. 19.

The upper side of the flange 27*e* abuts on the glass 4 as the upper surface 27*a* while the lower side of the flange 27*e* abuts on an upper side of a flange 2*a* of the timepiece case 2 as a rear surface 27*f*. When the rear surface 27*f* of the flange 27*e* protruding outside from the outside surface 27*c* of the dial trim ring 27 abuts on the flange 2*a* of the timepiece case 2, the light, which emits from the inside portion of the dial trim ring 27 in a part of the upper surface 27*a* of the dial trim ring 27 inside the flange 27*e*, is not blocked by the opaque timepiece case 2.

The reflection light that reflects the color of the different color member 12 and has reached the upper surface 7*a* and 17*a* from the inside in each of the dial trim rings 7 and 17 according to Embodiments 1 and 2 and the modified examples can emit from the upper surface 27*a* in the dial trim ring 27 according to Embodiment 3. The light that reflects the color of the solar cell 11 (refer to FIG. 23) is thereby prevented from being viewed on the upper surface 27*a*.

In the dial trim ring 27, a part of the light incident on the dial trim ring 27 substantially vertical to the dial 5 from the upper surface 27*a* reflects from the lower surface 27*b* to the outside surface 27*c* to be supplied for the power generation of the solar cell 11. The power generation effect of the solar cell can be further improved. In addition, the gate required for molding the dial trim ring 27 can be disposed on an outside end surface 27*g* of the flange 27*e*.

Embodiment 4

The dial trim ring 7 in Embodiment 1 includes the outside surface 7*c* inclined at the inclination angle $\theta$, and the dial trim ring 17 in Embodiment 2 and the dial trim ring 27 in Embodiment 3 include the lower surfaces 17*b* and 27*b* inclined at the inclination angle $\phi$. However, the dial trim ring in the electric timepiece with the solar cell according to the present invention may have an outside surface inclined at an inclination angle $\theta$ and a lower surface inclined at an inclination angle $\phi$. In addition, one of the inclination angle $\theta$ and the inclination angle $\phi$ may be a negative value and the other of the inclination angle $\theta$ and the inclination angle $\phi$ or the sum ($\theta+\phi$) of the inclination angle $\theta$ and the inclination angle $\phi$ may be a positive value exceeding 0.

One of the inclination angle $\theta$ and the inclination angle $\phi$ may be set to a large value as the main inclination angle while the other of the inclination angle $\theta$ and the inclination angle $\phi$ may be set to a small value for minor adjustment. This is effective when one of the inclination angle $\theta$ and the inclination angle $\phi$ cannot be set to a large value due to the limitation of the positional relationship with the other members (for example, dial 5 and solar cell 11).

Figure 25A:
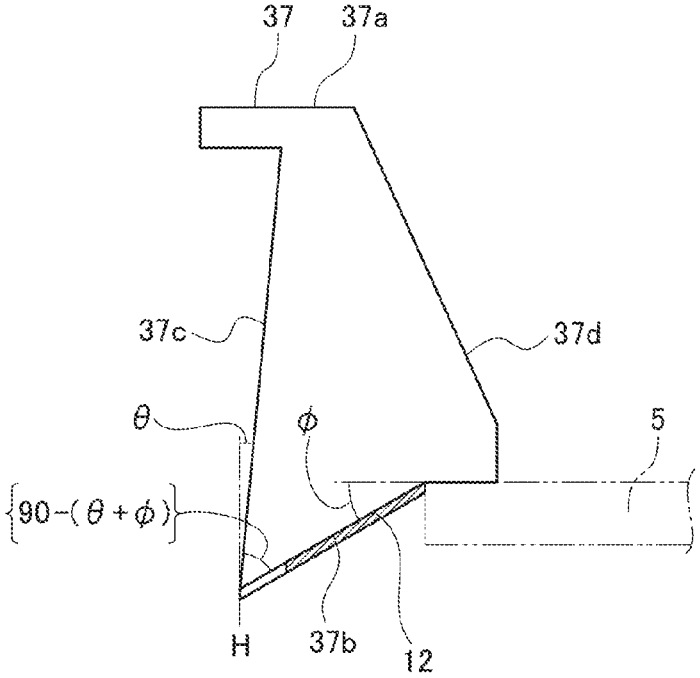
FIG. 25A is a view illustrating the dial trim ring having an outside surface inclined at an inclination angle of θ (>0 degree) and a lower surface inclined at an inclination angle of ϕ (>0 degree).
Figure 25B:
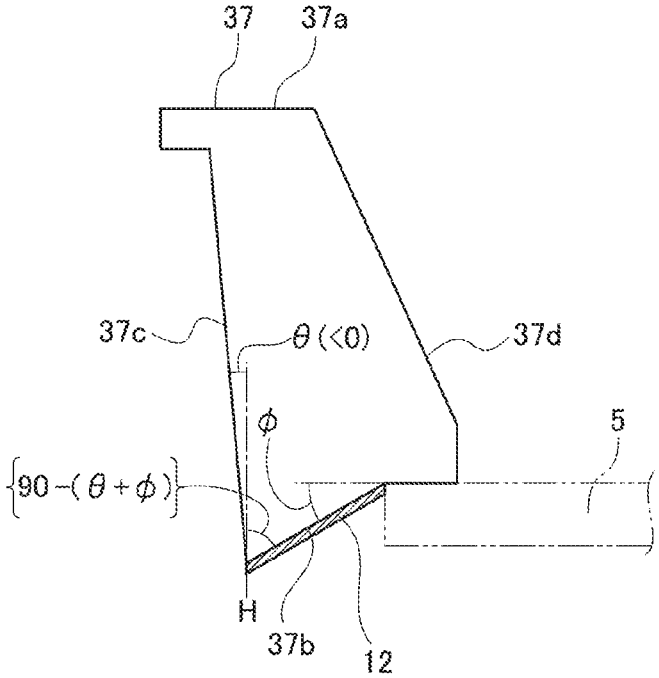
FIG. 25B is a view illustrating the dial trim ring having an outside surface inclined at an inclination angle of θ (<0 degree) and a lower surface inclined at an inclination angle of ϕ (>0 degree).

FIGS. 25A and 25B are views each illustrating a dial trim ring 37 including an outside surface 37*c* inclined at an inclination angle $\theta$ and a lower surface 37*b* inclined at an inclination angle $\phi$ (>0 degree).

More specifically, the dial trim ring 37 shown in FIG. 25A has the outside surface 37*c* that inclines ($\theta$>0 degree) inward toward the center portion of the dial 5 as going from the dial 5 in the height direction. On the other hand, the dial trim ring 37 shown in FIG. 25B has the outside surface 37*c* that inclines ($\theta$<0 degree) outward away from the center portion of the dial 5 as going from the dial 5 in the height direction.

In addition, in the dial trim ring 37 shown in FIG. 25B, the sum of the inclination angle θ (negative value) and the inclination angle φ (positive value) is a positive value.

In the dial trim ring 37 formed as described above, the angle (90−(θ+φ) between the outside surface 37*c* and the lower surface 37*b* is set to a sharp angle. The function and the effect similar to the dial trim rings 7, 17, and 27 in Embodiments 1, 2, and 3 can be obtained. As illustrated in FIGS. 25A and 25B, when both of the lower surface 37*b* and the outside surface 37*c* incline at the inclination angles φ and θ except 0 degree, one of the inclination surfaces or both of the inclination surfaces can be formed of any of the inclination surfaces shown in FIGS. 9A to 9D and 22A to 22D.

Figure 26A:
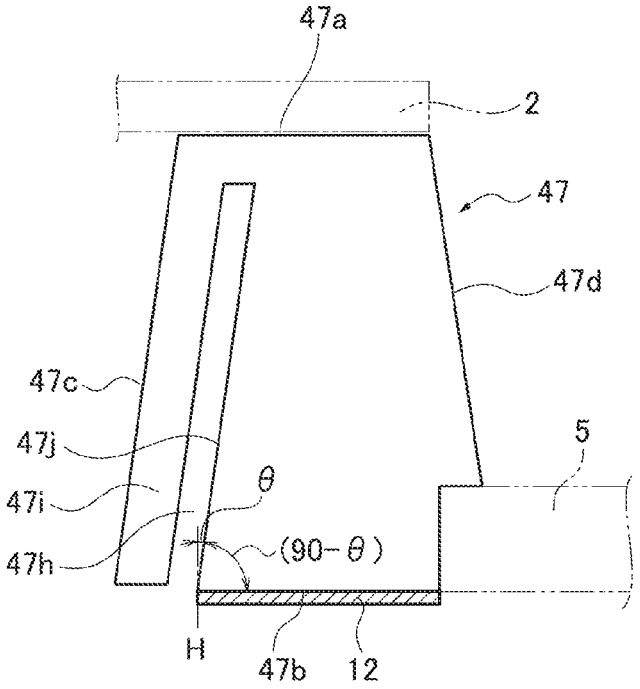
FIG. 26A is a view illustrating a dial trim ring in which a groove extending in a direction inclined at an inclination angle of θ relative to a normal line of the dial is formed inside an outermost circumference surface, and the outermost circumference surface inclines inward.
Figure 26B:
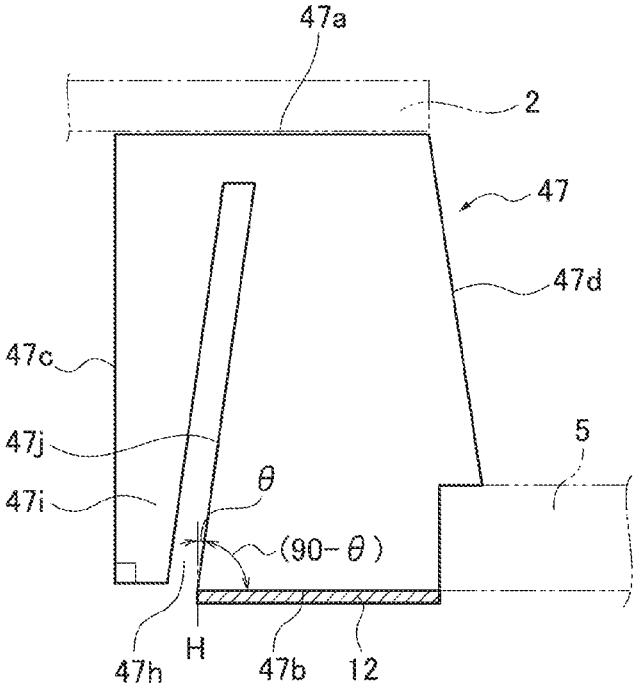
FIG. 26B is a view illustrating a dial trim ring in which a groove extending in a direction inclined at an inclination angle of θ relative to a normal line of the dial is formed inside an outermost circumference surface, and the outermost circumference surface does not incline inward.

FIGS. 26A and 26B are views each illustrating a dial trim ring 47 in which a groove 47*h* extending in a direction inclined at an inclination angle θ to the normal line H of the dial 5 is formed inside an outermost circumference surface 47*c*. The dial trim ring 47 in FIG. 26A has an external shape in which the outermost circumference surface 47*c* inclines inward. The dial trim ring 47 shown in FIG. 26B has an external shape in which the outermost circumference surface 47*c* does not incline. In each of the dial trim rings 47, the light incident on the inside of the dial trim ring 47 from the inside surface 47*d* reflects from the different color member 12 facing a lower surface 47*b* or a lower surface 47*b*, and then reflects from a surface 47*j* corresponding to the inside surface (close to dial 5) of the two surfaces of the side wall surfaces of the groove 47*h* before reflecting from the outermost circumference surface 47*c*.

More specifically, a part of the dial trim ring 47 corresponding to the outside surface of the dial trim ring in the electric timepiece with the solar cell of the present invention is the surface 47*j* as the inside wall of the groove 47*h* and a part 47*i* of the dial trim ring 47 located in the left side of the groove 47*h* is an external another member of the surface 47*j*, which corresponds to the outside surface. Accordingly, even in the dial trim ring 47 of FIG. 26B in which both of the outermost circumference surface 47*c* and the lower surface 47*b* do not incline, such a dial trim ring can be the embodiment of the dial trim ring in the electric timepiece with the solar cell according to the present invention by inclining the surface 47*j* of the inside wall of the groove 47*h* inward. In addition, in the dial trim ring 47, the angle (90−θ) between the surface 47*j* of the inside side wall of the groove 47*h* and the lower surface 47*b* is set to a sharp angle.

In the above embodiments and the modified examples, when the solar cell 11 has an enough power generation amount, the dial trim rings 7, 17, 27, 37, and 47 can be colored in addition to the coloring effect by the different color member 12. For example, the inside surfaces 7*d*, 17*d*, 27*d*, 37*d*, and 47*d* and the outside surfaces 7*c*, 17*c*, 27*c*, 37*c*, and 47*c* of the dial trim rings 7, 17, 27, 37, and 47 may be colored with a paint having a high light permeability, or the dial trim rings 7, 17, 27, 37, and 47 may be molded by colored resin having a high light permeability. The decoration performance of the dial trim rings 7, 17, 27, 37, and 47 can be thereby further improved.

The invention claimed is:

1. An electric timepiece with a solar cell comprising:

a dial;

a light permeable dial trim ring disposed to surround a center portion of the dial, the dial trim ring including at least a bottom and an outside surface; and a solar cell disposed outside the outside surface to face the outside surface, wherein the dial trim ring includes a first surface at least in a part of the outside surface and a second surface at least in a part of the bottom, a sum of a first angle at which the first surface inclines toward the center portion of the dial as going from the dial in a height direction and a second angle at which the second surface inclines downward in the height direction as going from the center portion exceeds 0 degree, and a different color member having a color different for that of a light-receiving surface of the solar cell is provided to face the second surface.

2. The electric timepiece with the solar cell according to claim 1, wherein the first surface and the second surface are smooth surfaces.

3. The electric timepiece with the solar cell according to claim 1, wherein the different color member is disposed in the bottom or is a member formed in the bottom.

4. The electric timepiece with the solar cell according to claim 3, wherein the different color member is the member disposed in the bottom, and the different color member is closely disposed in the bottom.

5. The electric timepiece with the solar cell according to claim 1, wherein at least one of the first surface in which the first angle exceeds 0 degree and the second surface in which the second angle exceeds 0 degree is formed in an entire circumference of the dial trim ring.

6. The electric timepiece with the solar cell according to claim 1, wherein the first angle exceeds 0 degree.

7. The electric timepiece with the solar cell according to claim 6, wherein the solar cell is disposed to separate from the outside surface, and a substance or a member having a refractive index smaller than that of the dial trim ring is provided between the first surface and the solar cell.

8. The electric timepiece with the solar cell according to claim 6, wherein the first surface is formed from an end portion of the outside surface on the dial side to an end portion of the outside surface on the side opposite to the dial side.

9. The electric timepiece with the solar cell according to claim 6, wherein the first surface inclines at a constant angle toward the center portion of the dial as going from the dial in the height direction.

10. The electric timepiece with the solar cell according to claim 6, wherein the first surface is not formed from the end portion of the outside surface on the dial side to a position at a predetermined height in the outside surface, and is formed at least in a part between the position at the predetermined height in the outside surface and the end portion of the outside surface on the side opposite to the dial side.

11. The electric timepiece with the solar cell according to claim 1, wherein the second angle exceeds 0 degree.

12. The electric timepiece with the solar cell according to claim 11, wherein at least a part of the second surface extends to a position lower than the surface of the dial in the height direction.

13. The electric timepiece with the solar cell according to claim 11, wherein the second surface is formed from a side surface in an outer circumference of the dial to the outside surface.

14. The electric timepiece with the solar cell according claim 11, wherein the second surface inclines downward in the height direction at a constant angle as going from the center portion.

15. The electric timepiece with the solar cell according to claim 11, wherein the second surface is not formed from an outer circumference end portion of the bottom to a position in a predetermined length in the bottom and is formed at least in a part between the position in the predetermined length in the bottom and an inner circumference end portion of the bottom.

* * * * *